US005851717A

United States Patent [19]

Tsubuko et al.

[11] Patent Number: 5,851,717

[45] Date of Patent: Dec. 22, 1998

[54] DEVELOPER FOR USE IN ELECTROPHOTOGRAPHY, AND IMAGE FORMATION METHOD USING THE SAME

[75] Inventors: Kazuo Tsubuko, Numazu; Akihiko Gotoh, Susono; Tsuyoshi Asami, Yokohama; Kazuyo Mizuno; Akihiro Koseki, both of Numazu, all of Japan

[73] Assignee: Ricoh Company, Ltd., Tokyo, Japan

[21] Appl. No.: 637,081

[22] Filed: Apr. 24, 1996

[30] Foreign Application Priority Data

Apr. 24, 1995 [JP] Japan ..... 7-123156
May 31, 1995 [JP] Japan ..... 7-155523

[51] Int. Cl.[6] ..... G03G 9/12

[52] U.S. Cl. ..... 430/111; 430/114

[58] Field of Search ..... 430/114, 111, 430/110, 115

[56] References Cited

U.S. PATENT DOCUMENTS 2,965,573 12/1960 Gundlach ..... 430/11
4,250,241 2/1981 Tsubuku et al. ..... 430/115
4,262,699 4/1981 Tsubuko et al. ..... 430/112
4,388,395 6/1986 Tsubuko et al. ..... 430/114
4,555,467 11/1985 Hasegawa et al. ..... 430/11
4,595,646 6/1986 Tsubuko ..... 430/114
4,634,651 1/1987 Okawara ..... 430/114
4,690,881 9/1987 Nagai et al. ..... 430/114
4,764,447 8/1988 Tsubuko et al. ..... 430/115
4,794,651 12/1988 Landa et al. ..... 430/11
4,797,341 1/1989 Tsubuko et al. ..... 430/114
4,855,207 8/1989 Tsubuko et al. ..... 430/109
4,925,763 5/1990 Tsubuko et al. ..... 430/106
4,957,842 9/1990 Fukase et al. ..... 430/114
5,026,621 6/1991 Tsubuko et al. ..... 430/109
5,061,587 10/1991 Tsubuko et al. ..... 430/109
5,169,739 12/1992 Umemura et al. ..... 430/114
5,204,207 4/1993 Yamashita et al. ..... 430/114
5,328,794 7/1994 Kazuo et al. ..... 430/109

*Primary Examiner*—John Goodrow
*Attorney, Agent, or Firm*—Oblon, Spivak, McClelland, Maier & Neustadt, P.C.

[57] ABSTRACT

A developer for use in electrophotography for developing latent electrostatic images to visible toner images, includes at least two kinds of toner particles with different shapes selected from the group consisting of spherical toner particles, fibrous toner particles and amorphous toner particles, each toner particle containing a coloring agent and a binder resin. There is provided a liquid developer including a toner which is dispersed in a carrier liquid, in which the toner includes at least two kinds of the above-mentioned toner particles with different shapes. An electrophotographic image formation method using the above-mentioned liquid developer is also provided.

20 Claims, 7 Drawing Sheets

DEVELOPER FOR USE IN ELECTROPHOTOGRAPHY, AND IMAGE FORMATION METHOD USING THE SAME

BACKGROUND OF THE INVENTION

1. Field of the Invention

The present invention relates to a developer for use in electrophotography, and more particularly, to a developer for developing a latent electrostatic image formed by the electrophotographic process into a visible toner image, comprising at least two kinds of toner particles with different specific shapes.

In addition, the present invention relates to an electrophotographic image formation method by use of the above-mentioned developer, comprising the step of applying a voltage to the toner image formed on a latent-electrostatic-image-bearable member, such as a photoconductor drum, prior to the image-transfer step.

2. Discussion of Background

To develop a latent electrostatic image formed on a latent-electrostatic-image bearable member by the electrophotographic process, the electrostatic recording process, or the electrostatic printing process, there are conventionally known a liquid development method and a dry development method.

The dry development method has the shortcoming that it is difficult to produce images with high sharpness and clearness because the average particle diameter of powdered developer is as large as about 7 $\mu$m. On the other hand, the particle diameter of a developer for use in the liquid development method is as small as 2 $\mu$m or less, generally, 1 $\mu$m or less. It is believed that the liquid developer is capable of producing high quality images, and therefore, the merits in the liquid developer have been discovered again.

The liquid developer for use with the liquid development method is prepared by suspending finely-divided toner particles in an organic solvent with electrically insulating properties. Since the particle diameter of the above-mentioned toner particles is very small, the reproduction performance of a thin line image becomes better and the image contrast becomes higher, as compared with those obtained by the dry development method. In addition, the characteristics of the liquid developer can also be sufficiently exhibited in the multi-color development using toners of four colors, such as yellow, magenta, cyan and black, with the result that full-colored images with high resolution and gradation can be obtained.

The liquid development method using an intermediate transfer member is proposed in order to achieve the high-speed development process without lowering the image quality of obtained images, as disclosed in U.S Pat. Nos. 4,945,387 and 4,984,025. By use of the intermediate transfer member, toner images can be transferred to a variety of transfer media in addition to a sheet-shaped transfer medium, such as a sheet of paper. However, the quality of the obtained images, and the processing speed of liquid development are limited because the electrostatic transfer method is still employed for the above-mentioned image-transfer step.

A liquid development method as disclosed in U.S. Pat. No. 4,708,406, is proposed in order to prevent the image quality of the transferred toner images from deteriorating. To be more specific, the above-mentioned liquid development method comprises the steps of transferring toner images formed on a latent-electrostatic-image-bearable member to an intermediate transfer member in the form of a belt or roller in such a fashion that the latent-electrostatic-image-bearable member is in close contact with the intermediate transfer member under the application of a predetermined pressure, and further transferring the toner images on the intermediate transfer member to a transfer medium such as a sheet of paper by the same method as mentioned above. However, the pressure applied to the latent-electrostatic-image-bearable member and the intermediate transfer member is limited in the apparatus for practical use, so that the image-transfer ratio is still insufficient and the image deterioration cannot be completely prevented at the image-transfer step.

Further, as disclosed in Wo 90/05942, there is proposed a method of transferring the toner images to an image-transfer medium with the application of heat to the toner images to provide the toner images with the adhesion, thereby improving the transferring properties and fixing properties of the toner images to the transfer medium. In this case, however, the intermediate transfer member in the form of a roller is heated, so that the toner images formed thereon are caused to deteriorate. Therefore, this image transferring process is considered to be free from reliability.

In Japanese Patent Publication 5-87825, there is described a toner comprising toner particles, each having a plurality of fibers. The above-mentioned toner particles are in the fibrous shape when existing in a liquid developer and after dried. When the above-mentioned toner is subjected to the conventional electrophotographic image formation process including development, squeezing and transferring steps, the initial development properties of the toner are good, but the transferring properties thereof are poor. To improve the transferring properties, it is necessary to increase the charge quantity of the toner by increasing the amount of a charge controlling agent for use in the toner. However, the charge controlling agent cannot be stably adsorbed by the toner particles in the fibrous form, so that the charge quantity of toner is decreased as the development process is repeated, and consequently, the transferring properties cannot be improved. Further, in the electrophotographic copying machine, the toner is replenished as the number of sheets subjected to copying operation is increased. Therefore, the concentration of the charge controlling agent in the developer is increased, so that the image density of the obtained image is decreased.

Furthermore, as disclosed in U.S. Pat. No. 4,984,025, when the toner particles in the fibrous form are employed for the conventional development process the uniformity of a solid image becomes poor, and image blurring easily occurs.

In the liquid development method, it is conventionally known that when the toner image formed on the latent-electrostatic-image-bearable member, that is, a photoconductor drum, is subjected to charging before the image-transfer step, the sharpness of the obtained toner image is improved. The above-mentioned charging operation is hereinafter referred to as precharging operation.

The effects obtained by the above-mentioned precharging operation will now be explained with reference to FIGS. 1 and 2.

As shown in FIG. 1, a layer comprising a liquid developer 2 with a predetermined thickness is formed on the surface of a photoconductor 1 to develop a latent electrostatic image to a visible toner image. The liquid developer layer 2 comprises a solvent 4, and toner particles 3 dispersed in the solvent 4, each toner particle comprising a pigment 5 such as carbon black and a binder resin. In the liquid develop layer 2, some toner particle 3 swell in contact with a large amount of solvent 4 during the electrophoresis and the resin component for use in the toner particle 3 dissolves in the solvent 4 and is formed into a resin layer 6 around a core particle of the pigment 5. A toner image contains the above-mentioned swelling toner particles, and these swelling toner particles are not securely fastened to the photoconductor 1. Therefore, when the toner image containing such swelling toner particles is transferred to a transfer sheet without the above-mentioned precharging, the toner image easily collapses as the photoconductor which bears the toner image thereon is brought into pressure contact with the transfer sheet. Thus, the problem of image blurring considerably occurs at the image-transfer step.

In contrast to this, when the toner image on the photoconductor 1 is subjected to precharging, the toner particles 3 are tightly attached to each other and firmly fixed to the photoconductor 1, as shown in FIG. 2. As a result, the toner image becomes tight, and can be uniformly transferred to an image-transfer sheet, and in particular, the toner image with excellent sharpness can be produced on the transfer sheet.

In light of the previously mentioned effect obtained by the precharging, the toner image formed on the photoconductor is conventionally subjected to precharging using a charging wire. However, the above-mentioned effect can be theoretically expected, but the charging wire is practically stained with the liquid developer, and vibrated due to the variation of the thickness of the liquid developer layer 2 formed on the photoconductor 1, so that the discharging becomes uneven. As a result, the toner images are not transferred to the transfer sheet uniformly.

In addition to the above, to fix the transferred toner image to the transfer sheet, a heat-application roller is conventionally employed. To be more specific, when the heat-application roller is brought into contact with the back of the transfer sheet, that is, opposite to the image-bearing aide thereof, as employed in the commercially available copying machine "RICOPY DT-1200" (Trademark), made by Ricoh Company, Ltd., it is necessary to increase the surface temperature of the heat-application roller to 200° C. or more to allow heat to pass through the toner-image-bearing side of the transfer sheet.

In order to fix the toner image on the transfer sheet at a lower temperature, the heat-application roller may be brought into direct contact with the toner-image-bearing side of the transfer sheet. This image-fixing method has been practically employed, for example, in the commercially available electrophotographic copying machine "FT-400i" (Trademark), made by Ricoh Company, Ltd. However, such a direct heating system has the drawback that a carrier liquid contained in the toner image deposited on the transfer sheet is pressed out by the application of pressure of the heat-application roller, thereby frequently inducing the blurring of toner images. Further, since the toner particles are easily attached to the surface of the heat-application roller, the so-called off-set phenomenon occurs. In addition, the image fixing performance is insufficient, and a solid image cannot be uniformly fixed to the transfer sheet by the direct heating system. To compensate the above-mentioned drawbacks, an additional device such as a device for removing the carrier liquid is necessitated.

It is therefore a first object of the present invention to provide a developer for use in electrophotography for developing latent electrostatic images to visible toner images, which can be fixed to an image-transfer member, such as a sheet of paper, at low temperature.

A second object of the present invention is to provide a developer for developing latent electrostatic images to visible toner images, which can be transferred to the transfer sheet and fixed thereon without blurring of the obtained toner image and unevenness of the solid image when the toner images are fixed on the transfer sheet by using the heat-application roller.

A third object of the present invention is to provide a developer, in particular, a liquid developer for developing latent electrostatic images to visible toner images, which can be readily dried and stably fixed on the transfer sheet although the toner particles for use in the liquid developer can be prevented from being deposited on the photoconductor during the intermission of a copying machine.

A fourth object of the present invention is to provide a developer for developing latent electrostatic images to visible toner images, which can be transferred to the transfer sheet from the photoconductor in good condition and fixed thereon with high resolution and excellent sharpness, without toner deposition on the background of the transfer sheet.

A fifth object of the present invention is to provide a developer with improved preservability and durability.

A sixth object of the present invention is to provide an electrophotographic image formation method using the above-mentioned liquid developer.

The first to fifth objects of the present invention can be achieved by a developer for use in electrophotography for developing latent electrostatic images to visible toner images, comprising at least two kinds of toner particles with different shapes selected from the group consisting of spherical toner particles, fibrous toner particles and amorphous toner particles, each of which toner particles comprises a coloring agent and a binder resin.

In the case of a liquid developer, the first to fifth objects of the present invention can be achieved by a liquid developer for use in electrophotography for developing latent electrostatic images to visible toner images, comprising a toner and a carrier liquid in which the toner is dispersed, the toner comprising at least two kinds of toner particles with different shapes selected from the group consisting of spherical toner particles, fibrous toner particles and amorphous toner particles, each of which toner particles comprises a coloring agent and a binder resin.

In the above-mentioned developer, it is preferable that the coloring agent comprise at least one coloring component selected from the group consisting of a phthalocyanine pigment, a disazo pigment, a carmine pigment, a quinacridone pigment and carbon black.

In this case, the coloring agent for use in the above-mentioned toner particles may be prepared by flushing treatment.

Alternatively, it is preferable that the coloring agent further comprise a resin and be prepared by kneading the coloring component in the resin.

It is preferable that the toner particles have a melt viscosity of 50 to 10000 Pa·sec at 120° C.

Furthermore, it is preferable that the spherical toner particles have a volume mean diameter of at least 0.5 $\mu$m, the fibrous toner particles have a volume mean diameter of at least 0.5 $\mu$m, and the amorphous toner particles have a volume mean diameter of 0.5 $\mu$m or less.

The previously mentioned sixth object of the present invention can be achieved by an electrophotographic image formation method comprising the steps of forming latent electrostatic images on the surface of a rotatable photoconductor drum; developing the latent electrostatic images to visible toner images by a liquid developer which is deposited on the latent electrostatic images by development means; regulating the amount of the liquid developer deposited on the latent electrostatic images to a predetermined amount by squeegee roller means which is disposed downstream of the development means in terms of the direction of the rotation of the photoconductor drum, with a predetermined gap between the squeegee roller means and the photoconductor drum, after the development of the latent electrostatic images; applying a voltage to the visible toner images formed on the photoconductor drum, thereby causing an electric current to flow through the visible toner images to the rotatable photoconductor drum by a voltage application means which is out of contact with the visible toner images and disposed downstream of the squeegee roller means in terms of the direction of the rotation of the photoconductor drum, with a predetermined gap between the voltage application means and the photoconductor drum; and transferring the visible toner images to a transfer sheet, with the liquid developer comprising a toner and a carrier liquid in which the toner is dispersed, the toner comprising at least two kinds of toner particles with different shapes selected from the group consisting of spherical toner particles, fibrous toner particles and amorphous toner particles, each of which toner particles comprises a coloring agent and a binder resin.

In the above-mentioned image formation method, it is preferable that the squeegee roller means be rotated in the same direction as that of the rotatable photoconductor drum.

In addition, it is preferable that the development means be in the form of a roller with a predetermined gap between the development means and the photoconductor drum, the voltage application means be in the form of a roller with a predetermined gap between the voltage application means and the photoconductor drum, and the gap between the squeegee roller means and the photoconductor drum be smaller than any of the gap between the development means and the photoconductor drum and the gap between the voltage application means and the photoconductor drum.

BRIE DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The inventors of the present invention have studied. to obtain a developer for use in electrophotography, which has excellent fixing properties and can be fixed on a transfer sheet at low temperature, with special attention being paid to the shape of toner particles and the kind of coloring agent for use in the developer. In the course of the aforementioned studies, a liquid developer with high durability has been discovered, which is capable of developing latent electrostatic images to visible toner images. The thus obtained toner images can be efficiently transferred to a transfer sheet, such as a sheet of paper, with high image density and without any toner deposition on the background of the transfer sheet. In addition, an electrophotographic image formation method suitable for the above-mentioned liquid developer has been discovered.

According to the present invention, there is provided a developer for use in the electrophotographic image formation method, comprising at least two kinds of toner particles with different shapes selected from the group consisting of spherical toner particles, fibrous toner particles and amorphous toner particles, each of which toner particles comprises a coloring agent and a binder resin.

The shape of the toner particles can be observed by using a commercially available scanning laser microscope "1LM Model-11" (Trademark), made by LOSER TEC Co., Ltd. when the toner particles are dispersed in a carrier liquid. In the case where the shape of the toner particles cannot be observed even by using the above-mentioned microscope because the particle size of toner particles is too fine, an electron microscope is usable. In this case, a sample of toner particles may be prepared by sufficiently diluting the toner particles with a carrier liquid, and removing the carrier liquid from the liquid developer under reduced pressure. The care must be taken that the temperature of the developer does not increase in removing the carrier liquid component from the liquid developer. This is because there is a risk of a thermoplastic resin for use in the toner particles being deformed by the application of heat, thereby changing the original shape of toner particles. The same care must be taken in the case where a sample of the developer is prepared by placing the developer on a carbon-deposited collodion film formed on a mesh and by using the transmission electron microscope (TEM).

The toner particle of the spherical shape, fibrous shape, and amorphous shape will now be explained in detail.

Figure 7:
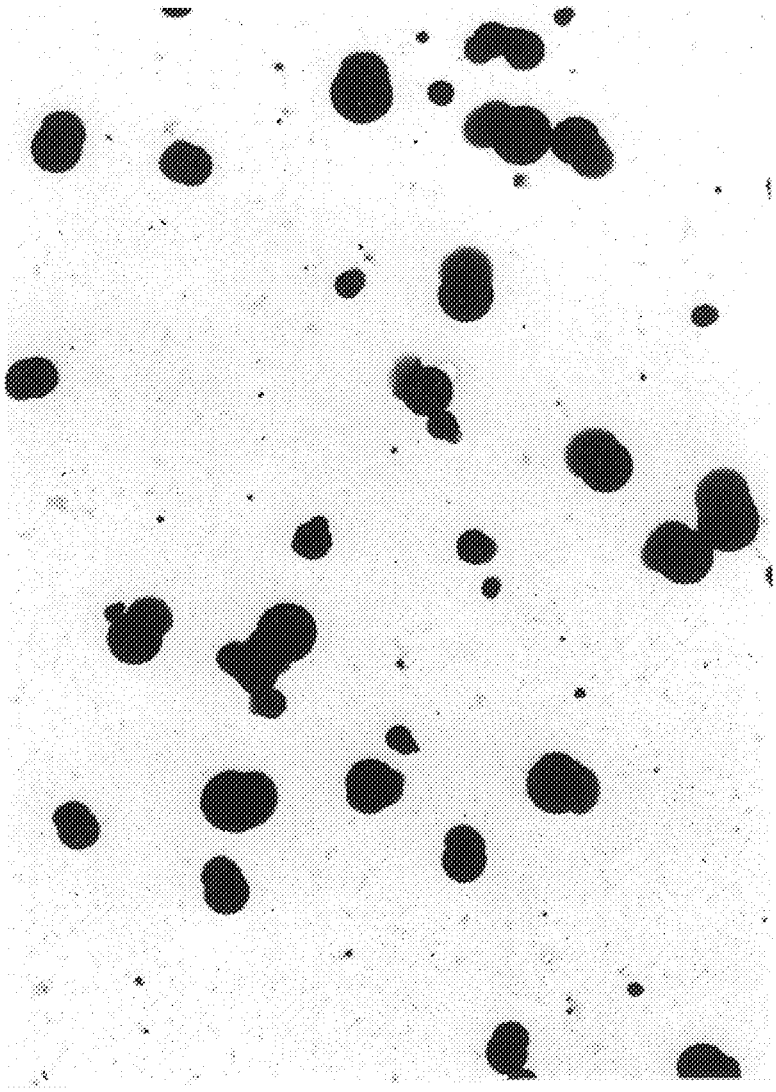
FIG. 7 is an electron microscope photograph of spherical toner particles for use in the present invention at a magnification of 3,200 times.

(1) Spherical shape: Toner particles with the shape of true sphere and ellipsoid without any striking convex and concave portions on the surface of the particles. FIG. 7 is an electron microscope photograph of spherical toner particles at a magnification of 3,200 times.

Figure 8:
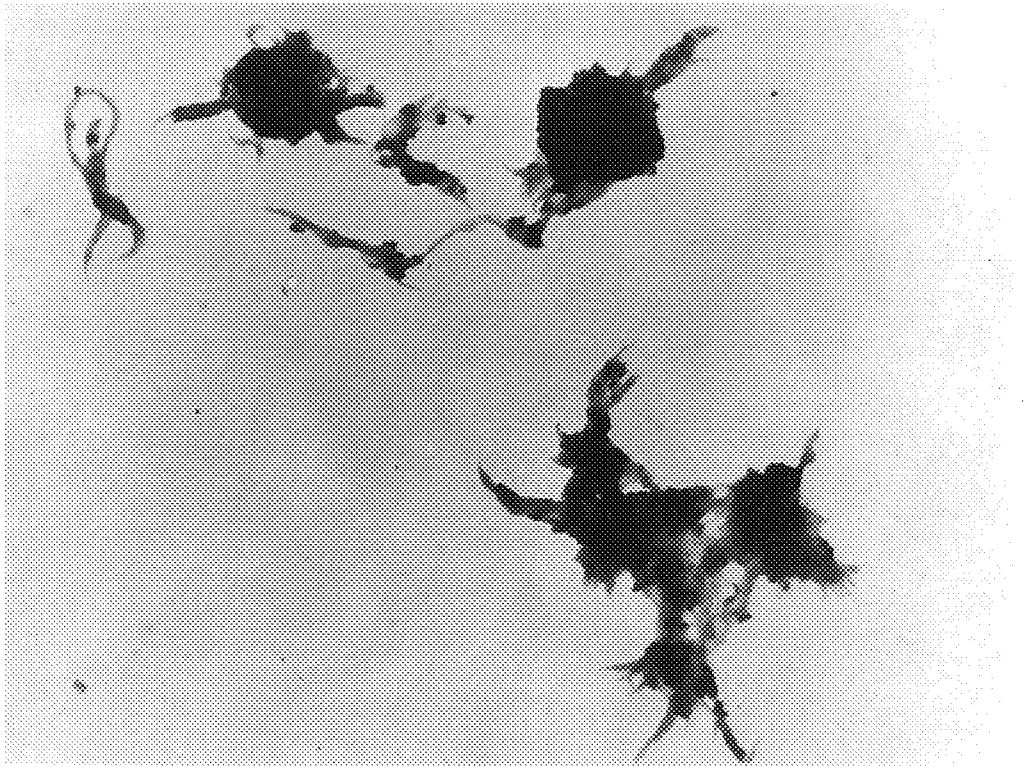
FIG. 8 is an electron microscope photograph of fibrous toner particles for use in the present invention at a magnification of 3,200 times.

(2) Fibrous shape: There are numerous fibers in the form of needles on the surface of the toner particles, as illustrated in U.S. Pat. No. 4,794,651. FIG. 8 is an electron microscope photograph of fibrous toner particles at a magnification of 3,200 times.

Figure 9:
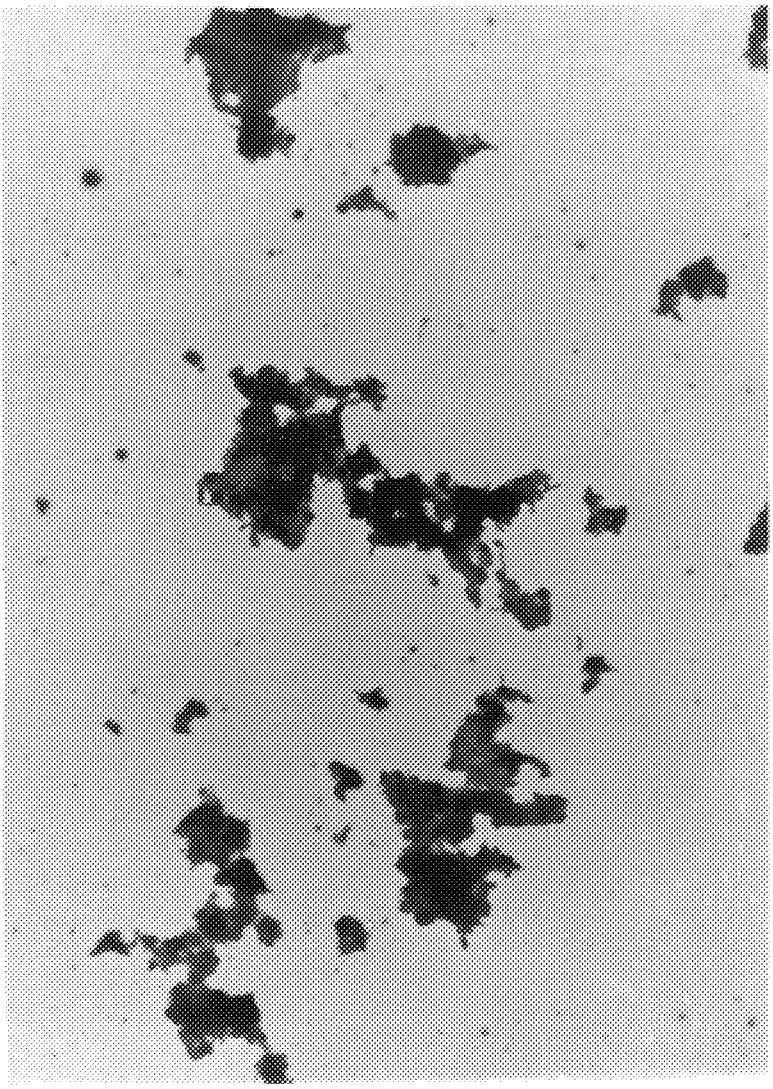
FIG. 9 is an electron microscope photograph of amorphous toner particles for use in the present invention at a magnification of 3,200 times.

(3) Amorphous shape: The shape of toner particles except the above-mentioned spherical shape and fibrous shape. FIG. 9 is an electron microscope photograph of amorphous toner particles at a magnification of 3,200 times. Further, the shape of the amorphous toner particles can be referred to the two photographs on page 239 of "Materials & Chemicals for Printer" issued by CMC Corporation Limited.

In the developer of the present invention, it is preferable that the toner particles have a melt viscosity of 50 to 10,000 Pa·sec, more preferably 100 to 8,000 Pa·sec, at 120° C. when the toner particles are in a dry state. When the melt viscosity of the toner particles is within the range of 50 to 10,000 Pa·sec, the toner image transferred to a transfer member shows sufficient image density, and the transferring and fixing performance of the toner image are satisfactory to such a degree that the uniformity of a solid image does not deteriorate. The number of toner particles in the amorphous form tends to increase when the melt viscosity of the toner particles is too low; while the number of toner particles in the spherical and fibrous forms tends to increase when the melt viscosity of the toner particles is too high.

Further, the toner particles with a melt viscosity of 50 to 10,000 Pa·sec can be fixed on the transfer sheet by use of a heat-application roller without the previously mentioned off-set phenomenon.

By using the toner particles of different shapes in combination, the conventional drawbacks can be solved.

The melt viscosity of the toner particles is measured by use of a commercially available apparatus "Rheometrics RVE-M" (Trademark), made by Rheometrics Incorporated in U.S.A. which includes a pair of rotatable disks with a diameter of 25 mm and disposed in parallel with a distance of 1 mm to 2 mm therebetween. The melt viscosity of the toner is measured as follower The toner particles for use in the present invention are separated from the carrier liquid by filtering through Toyo filter paper No. 2, and dried. Thereafter, the toner particles are placed between the pair of disks of the Rheometrics RVE-M. The toner particles are caused to reach a thermal equilibrium at 120° C. The measurement of the melt viscosity is started 5 minutes after the thermal equilibrium has been reached.

The upper disk of the Rheometrics RVE-M is oscillated to generate a torsion in the toner, and the torsion is converted to Pa·sec by use of a transducer connected to the lower disk of the Rheometrics RVE-M. Thus the melt viscosity of the toner particles can be measured by use of the above-mentioned mechanical coupling of this apparatus.

The above-mentioned oscillation can be generated with an angular frequency of 100 rad/sec and an amplitude of a 1% distortion.

The toner particles for use in the developer of the present invention comprises a coloring agent and a binder resin.

Examples of the binder resin for use in the toner particles are styrene-acrylic resin, polyester resin, natural resin, modified resin, acrylic ester resin, methacrylic eater resin, alkyd resin, vinyltoluene-acrylic copolymer, polyolefin, polyolefin copolymer, low-molecular weight polyethylene, and low-molecular weight polypropylene.

It is desirable that the coloring agent be incorporated in the above-mentioned binder resin, for example, by dispersing the coloring agent in the binder resin with the application of heat thereto.

In general, when the molecular weight of the binder resin to be employed is high, the toner particles of the spherical shape and fibrous shape are readily produced. On the other hand, the toner particles of the amorphous shape are produced by using a binder resin with a low molecular weight. To obtain the toner particles for use in the present invention, therefore, the toner particles prepared using a high-molecular weight resin may be mixed with those prepared using a low-molecular weight resin, or the toner particles may be prepared by kneading a coloring agent with a mixture of a high-molecular weight resin and a low-molecular wight resin.

To obtain the spherical toner particles, a resin which is insusceptible to salvation may be mainly employed as the binder resin component. For example, vinyltoluene, styrene, vinyl acetate, and a copolymer of vinyl chloride and acrylic ester or methacrylic acid ester may be selected as the binder resin component to prepare toner particles of the spherical shape.

Alternatively, it is preferable that a resin monomer a coloring agent such as carbon black be subjected to polymerization in a dispersion medium, with the addition of a polymerization initiator thereto. The spherical toner particles can be efficiently obtained by the above-mentioned polymerization method.

The method of preparing the fibrous toner particles, and the materials therefor may be referred to the references such as Japanese Laid-Open Patent Applications 48-97541, 51-123156, 45-49445 ; and 54-25833, and the preparation method of toner particles and obtained shape of toner particles are described in detail in Japanese Patent Publication 5-87825. However, it is difficult to obtain fibrous toner particles with a minimum dispersion of the shape and the particle diameter by dissolving a thermoplastic resin in an aliphatic hydrocarbon with the application of heat thereto, and dispersing carbon black and some organic pigment in the above-prepared resin solution. The thus prepared fibrous toner particles have the shortcoming that they tend to settle to the bottom of a liquid developer, and therefore, the dispersion properties of the fibrous toner particles are poor in the carrier liquid. In the present invention, the toner particles capable of assuming the fibrous form in a dry state although the spherical form in the liquid developer are preferred to the toner particles which are fibrous in a dry state and in the liquid developer as proposed in Japanese Patent Publication 5-87825.

The preferable method of preparing the fibrous toner particles is as follows: a mixture of a pigment and a thermoplastic resin is kneaded, and the thus kneaded mixture is dissolved and dispersed in an aliphatic hydrocarbon, with the addition thereto of other kinds of thermoplastic resins. Alternatively, the fibrous toner particles may be prepared by polymerization of a resin component and a coloring component, or making a graft polymer containing a pigment.

It is preferable that the thus obtained spherical toner particles and fibrous toner particles have a volume mean diameter of at least 0.5 $\mu$m.

It is preferable that the amorphous toner particles have a volume mean diameter of 0.5 $\mu$m or less.

The amorphous toner particles can be produced by the method as described in Japanese Laid-Open Patent Applications 59-100168, 58-108256 and 57-186758. In particular, it is preferable that a pigment be dissolved and dispersed in an aliphatic hydrocarbon with the addition thereto of a resin, for example, lauryl methacryalte-glycidyl methacrylate.

Since the conventional toner is singly composed of spherical toner particles, fibrous toner particles, or amorphous toner particles, the image-fixing temperature is high, the toner-image-fixing performance is poor, and the toner deposition on the background and image blurring easily happen. In contrast to this, when the developer comprising at least two kinds of toner particles with different shapes selected from the group consisting of spherical toner particles, fibrous toner particles and amorphous toner particles is applied to a wet-type copying machine, unexpected effects can be obtained. The reason for this is that latent electrostatic images formed on the photoconductor can be densely and closely developed by using the developer of the present invention. In addition, the transferring performance and fixing performance of the toner image can be improved, the toner image with high density can be obtained without image blurring. Further, thermal conduction between the toner particles becomes so smooth, thereby enabling the toner image to be fixed on the transfer sheet at low temperature. Furthermore, there is the problem of the conventional fibrous toner particles being deposited on the surface of the photoconductor during the intermission of the electrophotographic copying machine. This problem can be solved by the developer comprising spherical and amorphous toner particles for use in the present invention, which are hardly deposited on the surface of the photoconductor.

The toner particles for use in the present invention can exhibit sufficient fixing performance at a temperature as low as 80 to 150° C., and they can be prevented from being dried and deposited on the surface of the photoconductor.

To be more specific, various effects can be obtained according to the combination of toner particles of different shapes, as described later.

(A) The combination of fibrous toner particles and amorphous toner particles.

In this case, it is preferable that the fibrous toner particles be mixed with the amorphous toner particles at the mixing ratio by number of (20–80%):(80–20%), more preferably at the ratio by number of (30–70%):(70–30%).

When the mixing ratio of the fibrous toner particles is 80% or less of the total weight of the toner particles, deterioration of the image-fixing performance, occurrence of image blurring, and the increase of image-fixing temperature can be prevented. At the same time, the toner deposition on the background can be avoided when the mixing ratio of the fibrous toner particles is 20% or more.

(B) The combination of fibrous toner particles and spherical toner particles.

In this case, it is preferable that the fibrous toner particles be mixed with the spherical toner particles at the mixing ratio by number of (50–90%):(50–10%), more preferably at the ratio by number of (60–80%);(40–20%).

When the mixing ratio of the spherical toner particles is 10% or more of the total weight of the toner particles, deposition of toner particles on the photoconductor can be prevented, and the uniformity of a solid image is not caused to deteriorate. At the same time, poor image-fixing performance and image blurring can be avoided when the mixing ratio of the spherical toner particles is 50% or less.

(C) The combination of amorphous toner particles and spherical toner particles.

In this case, it is preferable that the amorphous toner particles be mixed with the spherical toner particles at the mixing ratio by number of (50–99%):(50–1%), more preferably at the ratio by number of (40–99%):(60–1%).

When the mixing ratio of the amorphous toner particles is 50% or more of the total weight of the toner particles, deposition of the toner particles on the photoconductor can be prevented during the intermission of the copying machine. At the same time, occurrence of image blurring can be avoided when the mixing ratio of the amorphous toner particles is 99% or less.

(D) The combination of fibrous toner particles, amorphous toner particles and spherical toner particles.

In this case, it is preferable that the fibrous toner particles, the amorphous toner particles and the spherical toner particles be mixed together at the ratio by number of (10–90%):(10–90%):(1–50%), more preferably at the ratio by number of (30–70%):(30–70%):(5–20%).

When the mixing ratio of the fibrous toner particles is 10% or more of the total weight of the toner particles, occurrence of toner deposition on background can be prevented. At the same time, occurrence of image blurring and deterioration of image-fixing performance can be avoided when the mixing ratio of the fibrous toner particles is 90% or less.

When the mixing ratio of the amorphous toner particles is 10% or more of the total weight of the toner particles, deterioration of image-fixing performance can be prevented. At the same time, the decrease of image density can be avoided when the mixing ratio of the amorphous toner particles is 90% or less.

When the mixing ratio of the spherical toner particles is 1% or more of the total weight of the toner particles, the uniformity of a solid image is not caused to deteriorate, and the image-transferring performance is not degraded. At the same time, poor image-fixing performance and image blurring can be avoided when the mixing ratio of the spherical toner particles is 50% or less.

The liquid developer of the present invention can exhibit remarkably striking effects when employed in the development process including the previously mentioned step of precharging the liquid developer layer formed on the photoconductor prior to the image-transfer step.

Figure 1:
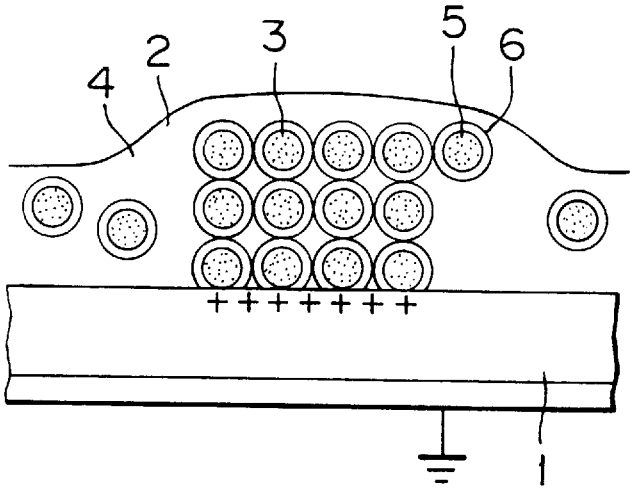
FIG. 1 is a schematic cross-sectional view showing a liquid developer layer which is formed on the surface of a photoconductor to develop a latent electrostatic image into a visible toner image, wherein the liquid developer layer is not subjected to precharging before the image-transfer step.
Figure 2:
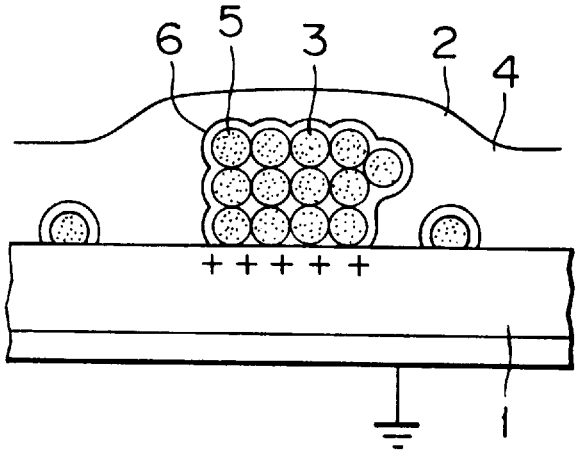
FIG. 2 is a schematic cross-sectional view showing a liquid developer layer which is formed on the surface of a photoconductor to develop a latent electrostatic image into a visible toner image, wherein the liquid developer layer is subjected to precharging before the image-transfer step.

The inventors of the present invention have conducted experiments in such a manner that an electric current of 5 to 200 $\mu$A is applied to a liquid developer layer formed on the photoconductor, as shown in FIG. 2, with the coloring agent for use in the developer being variously changed. As a result of the evaluations of the toner images obtained, toner images with minimum decrease in image density, free from the deterioration of resolution and the occurrence of toner deposition on the background can be formed when the coloring agent, such as a disazo yellow pigment, a carmine pigment, a quinacridone pigment, a phthalocyanine pigment or a carbon black is employed for the developer. The reason why the above-mentioned advantages can be obtained when such pigments are employed for the developer has not yet been thoroughly analyzed, but it is supposed that such pigments can be adsorbed by the charge controlling agent and the binder resin because a polar group is appropriately contained in a molecule of each pigment. Therefore, the polarity of the toner particles can be prevented from being biased by the application of the electric current thereto. Those pigments show excellent image-transfer performance and high durability and are capable of producing a toner image with high image density when employed in the conventional development process.

Specific examples of each of the above-mentioned pigments are as follows:

Examples of the dieazo yellow pigment include Pigment Yellow 12, Pigment Yellow 13, Pigment Yellow 14, Pigment Yellow 17, Pigment Yellow 55, Pigment Yellow 81, and Pigment Yellow 83.

Examples of the carmine pigment include Pigment Red 5, Pigment Red 57, Pigment Red 60, Pigment Red 114, Pigment Red 146, and Pigment Red 185.

Examples of the quinacridone pigment include Pigment Red 122 and Pigment Red 209.

Examples of the phthalocyanine pigment include Pigment Blue 15:1 (α-phthalocyanine), Pigment Blue 15:3, Pigment Blue 15:4, Pigment Blue 15:6, and Pigment Blue 16.

In particular, of the above-mentioned disazo yellow pigments, a compound represented by the following formula (I) is more preferable:

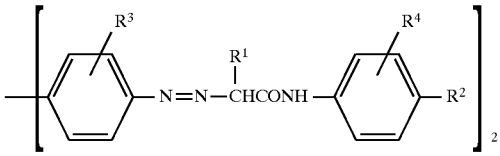

(I)

wherein $R^1$ is $COC_nH_{2n+1}$, in which n is an integer of 1 to 10; $R^2$ is $C_nH_{2n+1}$, in which n is an integer of 1 to 10; $R^3$ is hydrogen, an alkoxyl group or a halogen; and $R^4$ is hydrogen, an alkoxyl group or carboxyl group.

Specific examples of the disazo yellow pigment of formula (I) are as follows: Compound No.

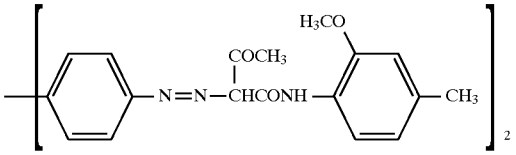

(I)-1

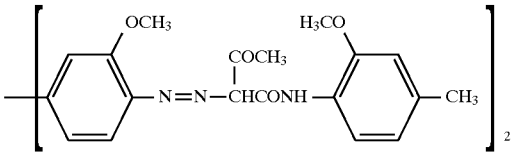

(I)-2

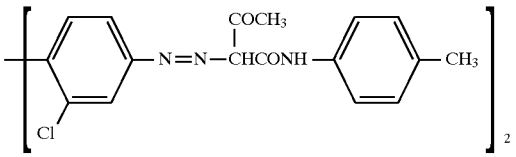

(I)-3

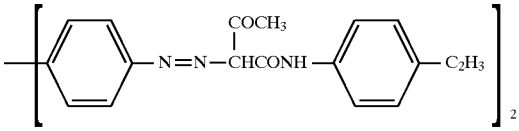

(I)-4

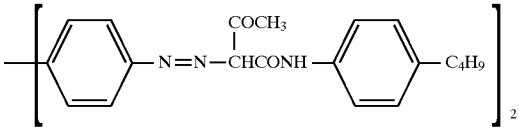

(I)-5

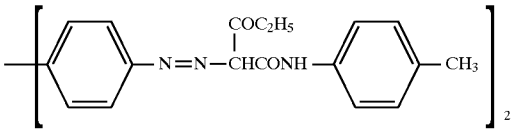

(I)-6

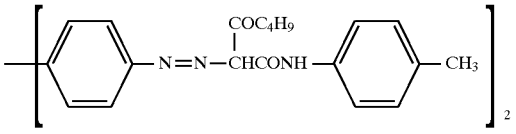

(I)-7

-continued

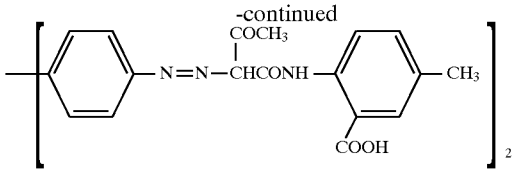

(I)-8

Of the above-mentioned carmine pigments, a compound represented by the following formula (II) is more preferable:

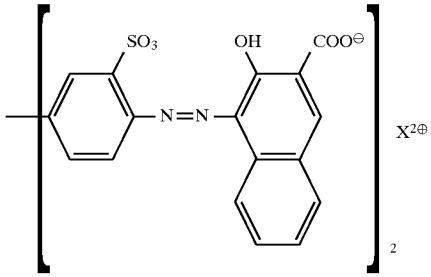

(II)

Specific examples of the carmine pigment of formula (II) are as follows:

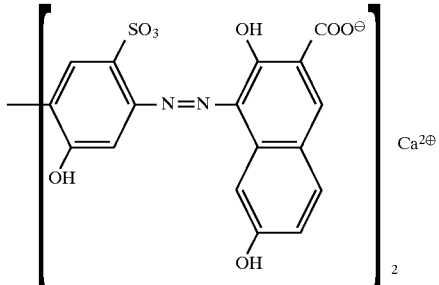

(II)-1

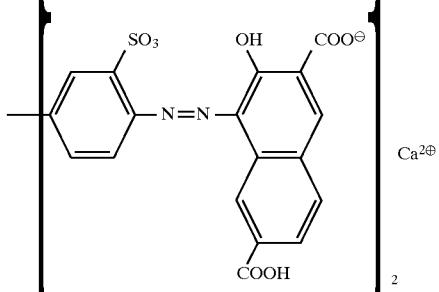

(II)-2

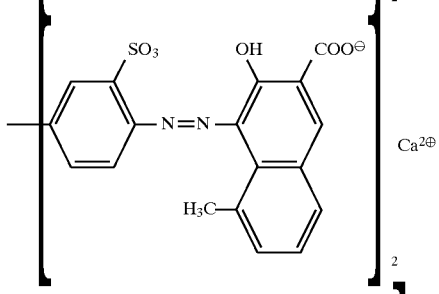

(II)-3

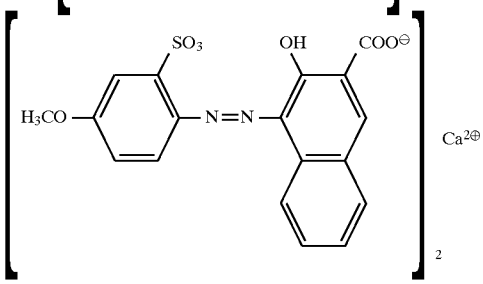

(II)-4

-continued
(II)-5
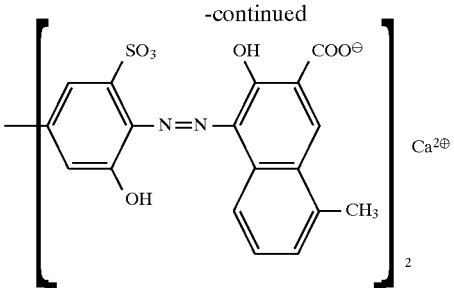
(II)-6
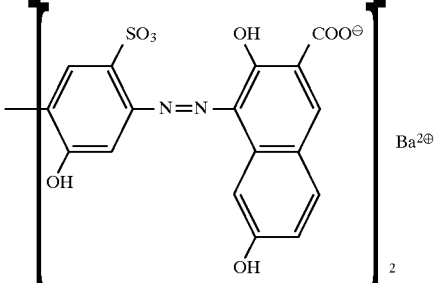
(II)-7
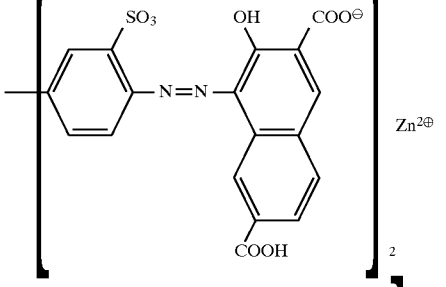
(II)-8
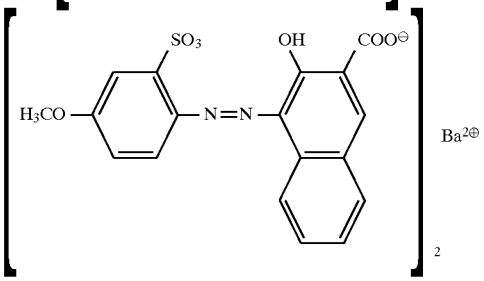
Of the above-mentioned phthalocyanine pigments, a compound represented by the following formula (III) is more preferable:
(III)
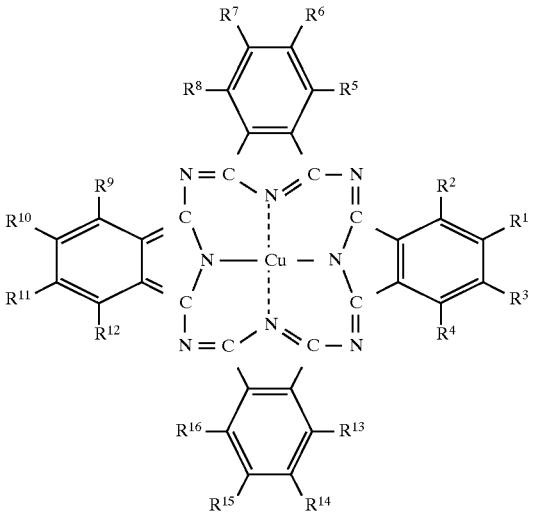
Specific examples of the phthalocyanine pigment of formula (III) are as follows:
(III-1)
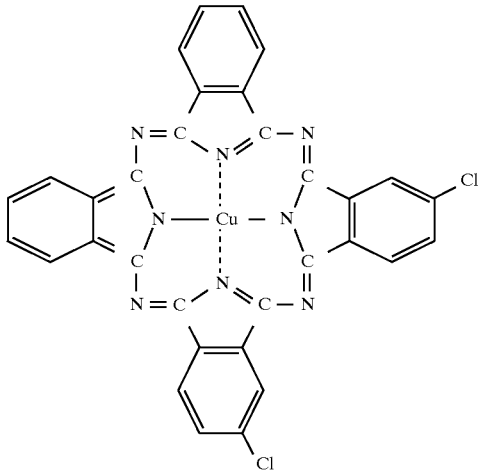
(III)-2
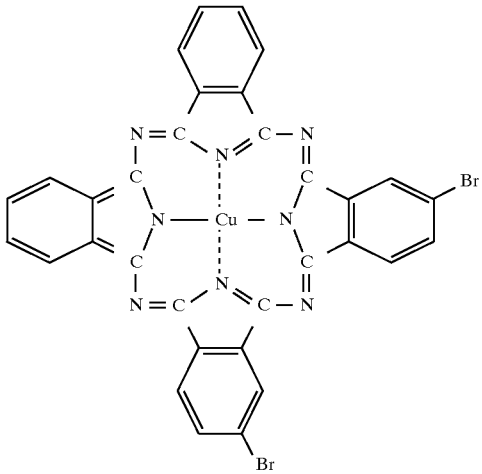
(III)-3
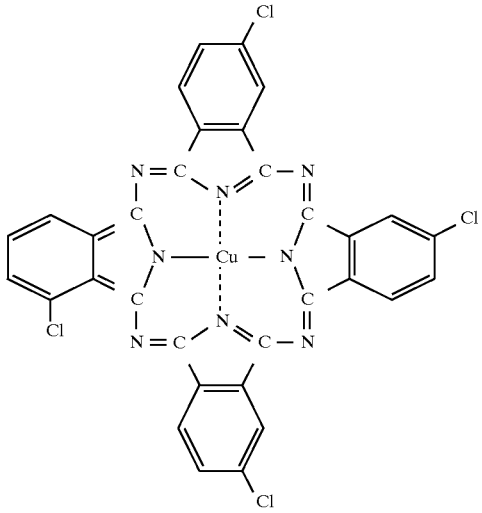

-continued (III)-4

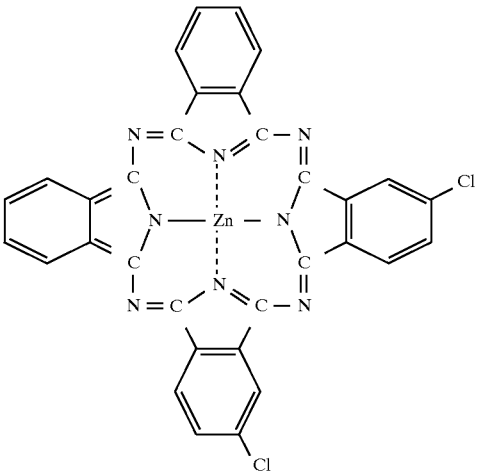

(III)-5

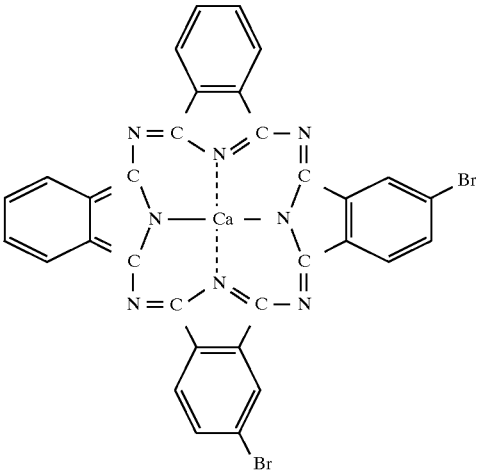

(III)-6

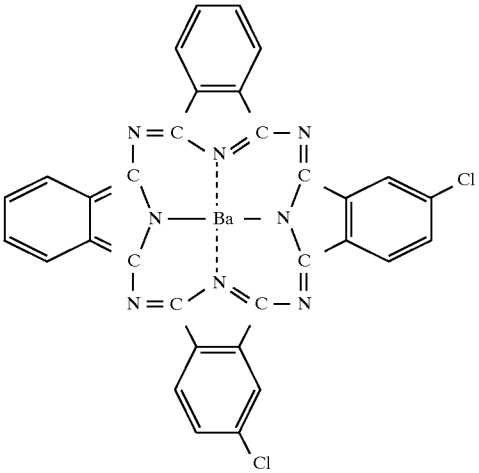

-continued (III)-7

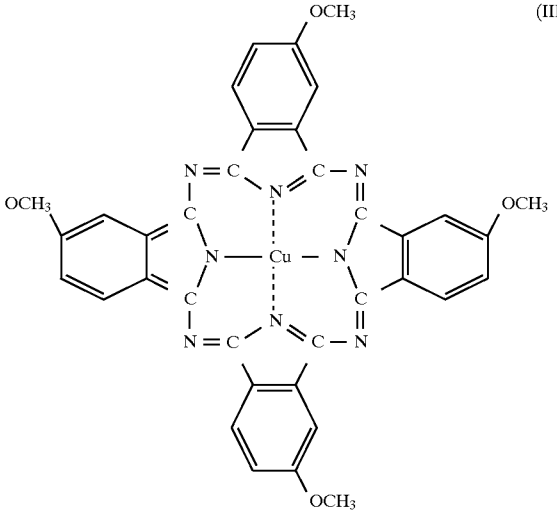

(III)-8

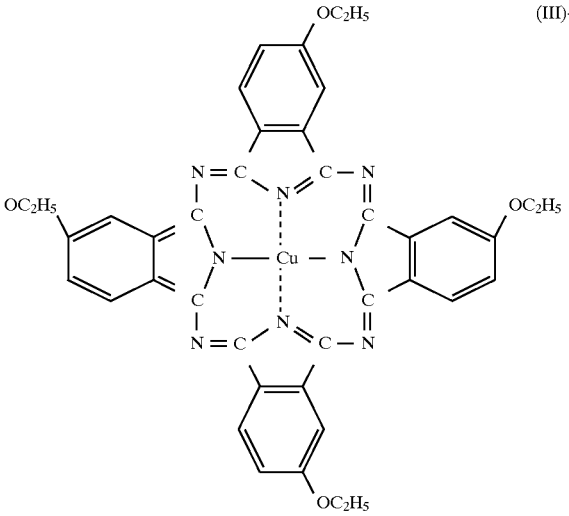

Of the carbon black, the following are preferably. employed in the present invention: furnace black, acetylene black, and channel black; and commercially available products such as "printex G", "Printex V", "Special Black 15", "Special Black 4" and "special Black 4-B" (Trademarks) made by Deguesa Japan Co., Ltd., "Mitsubishi #44", "Mitsubishi #30", "MA-11" and MA-100" (Trademarks) made by Mitsubishi Carbon Co., Ltd., "Raben 30", "Raben 40" and "Conductex SC" (Trademarks) made by Columbian Carbon Ltd., and "Reagal 4001", "Reagal 660", "Reagal 800" and "Black Pearl L" (Trademarks) made by Cabot Corporation.

According to the application of the developer, the following coloring agents such as organic pigments and inorganic pigments may be employed in combination with the above-mentioned pigments.

Examples of the organic pigment are Phthalocyanine Blue, Phthalocyanine Green, Rhodamine Lake, Malachite Green Lake, Methyl Violet Lake, Peacock Blue Lake, Naphthol Green B, Permanent Red 4R, Hansa Yellow, Benzidine Yellow, and Thioindigo Red.

Examples of the inorganic white pigments are zinc oxide, titanium oxide, and silicon oxide.

The toner for use in the present invention may further comprise a charge controlling agent.

In the liquid developer of the present invention, toner particles comprising the coloring agent and the binder resin are dispersed in a carrier liquid, that is, a non-polar dispersion medium. The liquid developer according to the present invention can be prepared in accordance with the following preparation method:

A mixture of one part by weight of the coloring agent and 0.3 to 3 parts by weight of the binder resin, with the addition of the charge controlling agent thereto when necessary, are dispersed in the presence of 0.1 to 20 parts by weight of the dispersion medium in a dispersion mixer such as a keddy mill, beads mill, attritor or ball mill to prepare a concentrated toner in which toner particles with a volume mean diameter of 20 $\mu$m or less, preferably in the range of 0.1 to 3 $\mu$m are dispersed in the dispersion medium. The thus obtained concentrated toner may be diluted with a carrier liquid when necessary.

Representative examples of the carrier liquid for use in the liquid developer of the present invention include isododecane, n-hexane, isobutyl myristate, and fluorine-containing oil; commercially available aliphatic hydrocarbon carrier liquids such as "Isopar H", "Isopar G", "Isopar L", and "Isopar M" (Trademarks), made by Exxon Chemical Japan Ltd; and commercially available silicone oil products such as "KF995", "KF994", "KF85" and "KF-96-300CS" (Trademarks), made by Shin-Etsu Chemical Co., Ltd. It is desirable that the carrier liquid have high insulating characteristics and low dielectric characteristics and be non-odorous. In addition, an aliphatic ester, a paraffin and a wax which assumes a solid state at room temperature and is changed to a liquid state at 35° C. or more may be used as the dispersion medium.

When necessary, the charge controlling agent such as metallic soap or lecithin can be added in a slight amount to the toner.

It is preferable that the amount of the binder resin in the range of 0.1 to 20 parts by weight, more preferably in the range of 0.5 to 10 parts by weight, to one part by weight of the coloring agent. When the binder resin is contained in the toner in the above-mentioned amount, the dispersion properties of the developer are sufficient and the image-fixing properties are satisfactory, and at the same time, the decrease of the image density can be prevented.

The toner for use in the present invention comprising the previously mentioned specific coloring agent has the advantages that the image-transfer ratio is high, and the toner image with high image density can be produced on the transfer sheet without the toner deposition on the background thereof when the toner is used for a dry color toner. In such a case, a mixture of one part by weight of the binder resin, 0.01 to 0.3 parts by weight of the coloring agent and a trace amount of the charge controlling agent may be kneaded by the application of heat thereto, and the obtained mixture may be pulverized to prepare toner particles with a particle diameter of 3 to 10 $\mu$m.

As previously mentioned, inorganic and organic pigments can be employed as the coloring agent, but a coloring agent prepared by a flushing method is preferable for use in the present invention. By the flushing method, the particles of the coloring agent are dispersed to primary particles, so that the gradation, resolution, and image density of the image obtained by a liquid developer comprising the above prepared coloring agent are improved.

The flushing method for use in the present invention is conducted as follows:

A pigment or a water-containing paste of a pigment and a resin solution are thoroughly mixed and kneaded in a kneader called flusher. In the above kneading step, water which exists around the particles of the pigment are replaced by the resin solution. The above mixture is taken out of the kneader and the water phase of the mixture is discarded to obtain a pigment dispersion in which the particles of the pigment are dispersed in the resin solution. The pigment dispersion is dried to remove the solvent therefrom, whereby a material in the form of mass is obtained. The thus obtained material is ground.

The material obtained in accordance with the above-mentioned flushing method is referred to as "a flushing pigment" in the present invention. In the above kneading process, the water and solvent may be removed from the mixture under reduced pressure while the mixture is kneaded in the kneader. In this flushing method, not only the pigment itself, but a mixture of the pigment and water, is kneaded to form a lump of the pigment, and the results are substantially the same with respect to both the case where the pigment is used, and the case where the mixture of the pigment and water is used. Therefore, a dye treated by the flushing method can also be employed as a toner component in the present invention. It is preferable that the mixing ratio of the pigment or dye to the resin be in the range of (1:1) to (2:8). In particular, it is effective to carry out the flushing treatment in the presence of humic acid, salts of humic acid such as ammonium humate and sodium humate, or humic acid derivatives. An appropriate amount of the above-mentioned humic acid to be added to the mixture is about 0.1 to 30 wt. % of the dye- or pigment-containing aqueous liquid.

A representative example of the method of preparing a flushing pigment will now be described in detail.

[Preparation of Flushing Pigment No. 1]

20 g of ammonium humate was sufficiently dissolved in 200 g of water in a gallon kneader to prepare a solution. 250 g of commercially available carbon black "Mitsubishi #44" was added to the above solution in the kneader and thoroughly dispersed to obtain a dispersion. To the thus obtained dispersion, 750 g of ethylene maleic acid—ethyl acrylate copolymer with a molar ratio of (80:0.5:19.5) was added and mixed under the application of heat at about 160° C., and water was removed therefrom. The above mixture was further kneaded at about 120° C. for 4 hours, subjected to vacuum drying, cooled, and ground, whereby a flushing pigment No. 1 was prepared.

To prepare the developer of the present invention, the coloring agent may be prepared by the flushing treatment. The coloring agent may further comprise a resin and is prepared by kneading a coloring component in the resin. Namely, it is preferable to incorporate the coloring agent in the resin, with the addition of a dispersion medium and a charge controlling agent when necessary. The thus obtained developer can produce toner images with high resolution and high image density because the coloring agent is uniformly coated by the resin and the obtained toner particles have uniform dispersion properties.

Furthermore, images with high image density and excellent resolution can be obtained when the previously mentioned liquid developer of the present invention is applied to the image formation method comprising the steps of forming latent electrostatic images on the surface of a rotatable photoconductor drum; developing the latent electrostatic images to visible toner images by a liquid developer which is deposited on the latent electrostatic images by development means; regulating the amount of the liquid developer deposited on the latent electrostatic images to a predetermined amount by squeegee roller means which is disposed downstream of the development means in terms of the direction of the rotation of the photoconductor drum, with a predetermined gap between the squeegee roller means and the photoconductor drum, after the development of the latent electrostatic images; applying a voltage to the visible toner images formed on the photoconductor drum, thereby causing an electric current to flow through the visible toner images to the rotatable photoconductor drum by a a voltage application means which is out of contact with the visible toner images and disposed downstream of the squeegee roller means in terms of the direction of the rotation of the photoconductor drum, with a predetermined gap between the voltage application roller means and the photoconductor drum; and transferring the visible toner images to a transfer sheet. Such image formation method will now be explained with reference to FIGS. 3 and 5.

Figure 3:
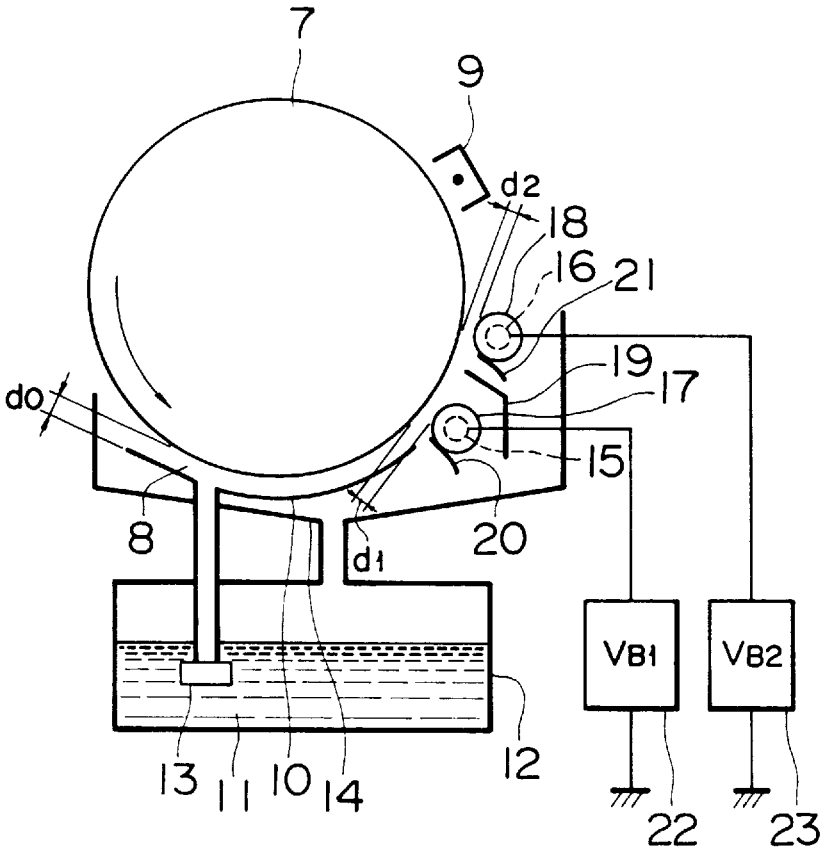
FIG. 3 is a schematic diagram which explains one example of the development step for use in the electrophotographic image formation method using a liquid developer according to the present invention.
Figure 4:
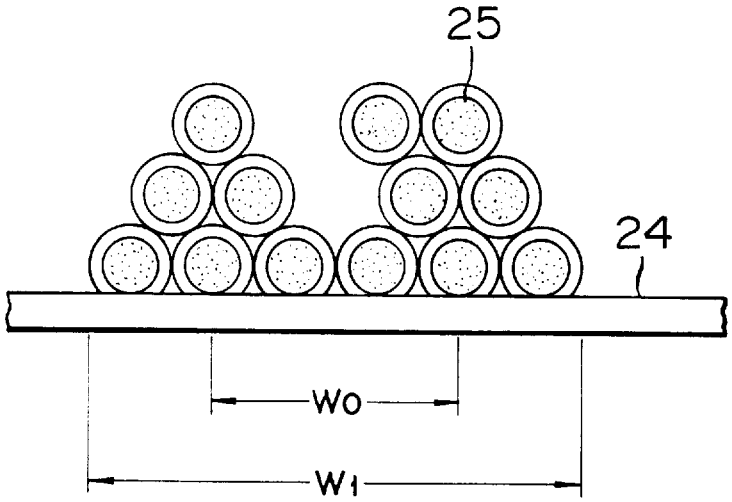
FIG. 4 is a schematic cross-sectional view showing a toner image which is transferred to a transfer sheet without precharging operation.

As illustrated in FIG. 3, a photoconductor drum 7 which serves as a latent-electrostatic-image bearing member is rotatably provided, and a development unit 8 and an image-transfer unit 9 are disposed along the rotational direction of the photoconductor drum 7.

In the development unit 8, a development electrode 10 which is disposed in parallel with a part of the circular arc of the photoconductor drum 7 is connected to. a liquid developer supply pump 13 which is situated in a developer tank 12 in which a liquid developer 11 is stored. A developer receiving tray 14 which is connected to the developer tank 12 is located under the development electrode 10. The distance ($d_0$) between the development electrode 10 and the surface of the photoconductor drum 7 is set to 0.6 to 1.0 mm.

Between the development unit 8 and the image-transfer unit 9, a squeegee roller 17 and a voltage-application roller 18 are disposed, included in the developer-receiving tray 14. The squeegee roller 17 is rotated at a high speed (100 to 400 rpm) in the same direction as that of the photoconductor drum 7. The gap ($d_1$) between the squeegee roller 17 and the photoconductor drum 7, and the gap ($d_2$) between the voltage-application roller 18 and the photoconductor drum 7 are adjusted respectively by using the bearings 15 and 16, each of which has a diameter larger than that of the squeegee roller 17 or the voltage-application roller 18 and is coaxially provided so as to be rotatable and in contact with the edge surface of the photoconductor drum 7. It is preferable that the gap ($d_1$) be set to 50 to 100 $\mu$m, and the gap ($d_2$) be adjusted to be larger than the gap ($d_1$), that is, in the range of 100 to 200 $\mu$m. The reason for this is that the voltage-application roller 18 is capable of applying a voltage to a liquid developer layer formed on the surface of the photoconductor drum 7 and causing an electric current to flow into the liquid developer layer in such a condition that the liquid developer layer is not in contact with the voltage-application roller 18.

There is a separator 19 located between the squeegee roller 17 and the voltage-application roller 18. Further, blades 20 and 21 are respectively provided to scrape away the liquid developer adhering to the squeegee roller 17 and the voltage-application roller 18. The squeegee roller 17 is connected to a bias source 22 capable of applying a bias potential ($V_{B1}$) to the squeegee roller 17; while the voltage-application roller 18 is connected to a bias source 23 capable of applying a bias potential ($V_{B2}$) to the voltage-application roller 18.

For example, when the photoconductor drum 7 is positively charged to a predetermined potential in the range of +1000 to +1300 V at the charging step, it is desirable that the bias potential ($V_{B1}$) be in a floating condition, and the bias potential ($V_{B2}$) be in the range of 200 to 0 V. In addition, an electric current of 1 to 1000 $\mu$A may be caused to flow through the toner images formed on the photoconductor drum 7 by the voltage-application roller 18.

The photoconductor drum 7, the squeegee roller 17 and the voltage-application roller 18 are driven in rotation at a predetermined rotational speed. Prior to the development step, the photoconductor drum 7 has been charged to a predetermined charging potential and exposed to light images, thereby obtaining latent electrostatic images on the photoconductor drum 7. When the latent electrostatic images formed on the photoconductor drum 7 reaches the development unit 8, the toner for use in the liquid developer 11 placed on the development electrode 10 is attached to the latent electrostatic images, so that the latent electrostatic images are developed into visible toner images. In this case, the liquid developer layer is first caused to adhere to the latent electrostatic images formed on the surface of the photoconductor drum 7 because of the viscosity of the liquid developer. Then, the amount of the liquid developer deposited on the latent electrostatic images formed on the surface of the photoconductor drum 7 is regulated by the squeegee roller 17 which is disposed downstream of the development electrode 10 in terms of the direction of the rotation of the photoconductor drum 7. The toner images obtained on the photoconductor drum 7 are not collapsed in the course of removal of the excess liquid developer by the action of the squeeze roller as described in Japanese Laid-Open Patent Application 51-8941. Since the bias potential ($V_{B2}$) is applied to the voltage-application roller 18, toner particles constituting the toner image become tight, so that sharp toner image can be formed on the surface of the photoconductor drum 7.

Thereafter, the toner image is transferred to a transfer sheet such as a sheet of paper in the image-transfer unit 9.

Figure 5:
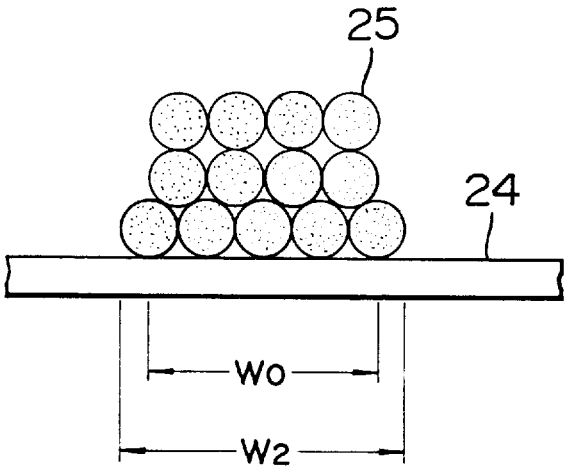
FIG. 5 is a schematic cross-sectional view showing a toner image which is transferred to a transfer sheet after the precharging operation.

FIG. 5 is a schematic cross-sectional view of the toner image transferred to a transfer sheet according to the image formation method of the present invention. In FIG. 5, reference numeral 24 indicates a transfer sheet; and reference numeral 25, toner particles constituting the toner image. According to the present invention, the voltage is applied to the visible toner image formed on the photoconductor drum 7 by the voltage-application roller 18 before the toner image is transferred to the transfer sheet 24, so that the sharpness of the transferred toner image is improved. For instance, if the width of a latent electrostatic image is $W_0$, the width of a toner image, corresponding to the above-mentioned latent electrostatic image, transferred to the transfer sheet 24 becomes $W_2$, which is almost the same as $W_0$, as shown in FIG. 5. In contrast to this, when the toner image on the photoconductor drum 7, which has not been subjected to charging prior to the image-transfer step is transferred to the transfer sheet 24, the width of the transferred toner image ($W_1$) becomes still larger than the width ($W_0$) of the latent electrostatic image, thereby decreasing the sharpness of the toner image.

In the previously mentioned development process with reference to FIG. 3, there are two voltage-application steps capable of applying the voltage to the toner image formed on the photoconductor drum 7. Further, three voltage-application steps may be employed in the development process for the practical use. In this case, the bias potential with an opposite polarity to that of the charging potential of the photoconductor drum 7 is applied only to the final voltage-application means, and the rest may be in the floating state or charged to the same polarity as that of the photoconductor drum 7.

Figure 6:
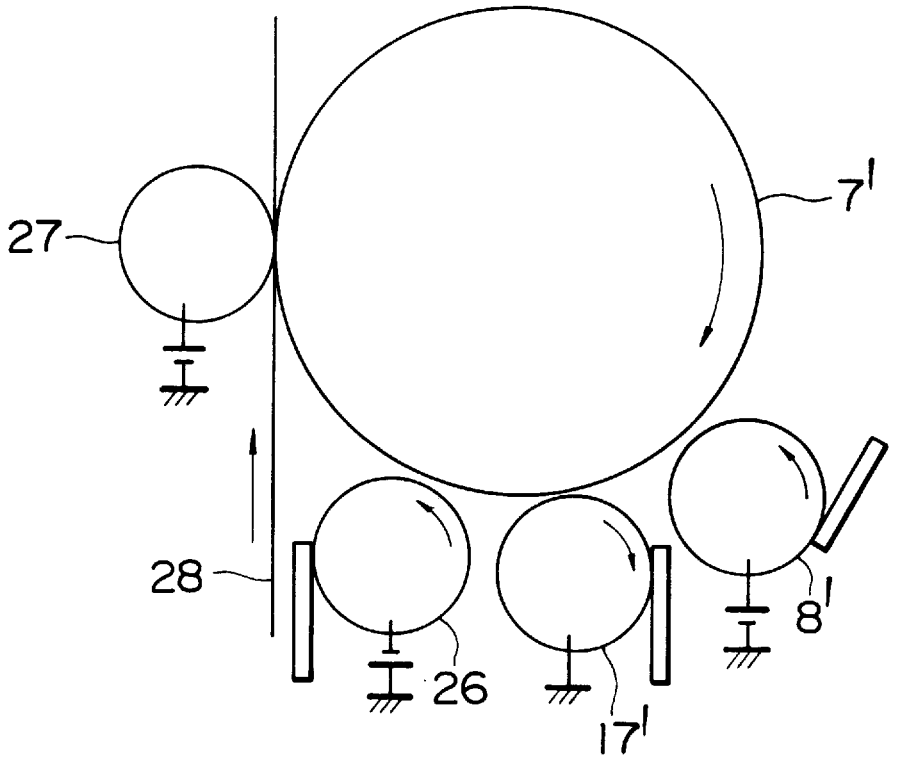
FIG. 6 is a schematic diagram which explains another example of the development step for use in the electrophotographic image formation method using a liquid developer according to the present invention.

FIG. 6 is a schematic diagram which shows another example of the image formation method of the present invention, in which the development means in the form of a roller and the voltage application means in the form of a roller are preferably employed.

In FIG. 6, a latent electrostatic image formed on a photoconductor drum 7' is developed into a visible toner image by a developer according to the present invention which is supplied by a development roller 8'. A squeegee roller 17' is disposed downstream of the development roller 8' in terms of the direction of the rotation of the photoconductor drum 7', with a predetermined gap between the squeegee roller 17' and the photoconductor drum 7'.

Further, a voltage-application roller 26 is disposed downstream of the squeegee roller 17' in terms of the direction of the rotation of the photoconductor drum 7', with a predetermined gap between the voltage-application roller 26 and the photoconductor drum 7'. In this embodiment, the toner image formed on the photoconductor drum 7' is transferred to a transfer sheet according to the belt roller transfer method. Reference numeral 27 indicates an image-transfer roller, and reference numeral 28, an image-transfer belt. In this case, the same effects as those in the development process as illustrated in FIG. 3 can be obtained.

In the image formation method of the present invention, the photoconductor drum serving as a latent-electrostatic-image bearing member comprises as a photoconductive material an inorganic material such as cadmium sulfide, amorphous-silicon or selenium, or an organic photoconductive material. In any case, it is preferable that the photoconductor drum comprise an overcoat surface layer treated to be water-repellent and oil-repellent. The development can be conducted due to the difference of surface energy of the photoconductor drum and the wettability of the photoconductor drum. In particular, the amorphous-silicon photoconductor drum is preferable from the viewpoints of the solvent resistance and the image-transfer performance.

Other features of this invention will become apparent in the course of the following description of exemplary embodiments, which are given for illustration of the invention and are not intended to be limiting thereof.

Example 1

A mixture of the following components was dispersed in an attritor for 2 hours:

| | Parts by Weight |
|---|---|
| Styrene | 20 |
| Stearyl methacrylate | 50 |
| Benzoyl peroxide (polymerization initiator) | 2 |
| Lecithin | 1 |
| Ethylene-acrylic acid copolymer | 50 |
| Carbon black | 50 |

The above-prepared mixture was added dropwise to 500 parts by weight of the commercially available aliphatic hydrocarbon (Trademark "Isopar M", made by Exxon Chemical Japan Ltd.) in a flask over a period of 2 hours, and the reaction mixture was stirred at 90° C. to carry out the polymerization. Thus, a toner for use in the present invention was prepared.

According to the electron microscope photograph of the toner, there were observed spherical toner particles, fibrous toner particles and amorphous toner particles at the mixing ratio by number of about 30:45:25.

50 g of the above prepared toner was dispersed in 1,000 g of the commercially available aliphatic hydrocarbon (Trademark "Isopar H", made by Exxon Chemical Japan Ltd.), so that a liquid developer No. 1 of the present invention was obtained.

The liquid developer No. 1 was set in a commercially available copying machine (Trademark "Ricopy FT400i", made by Ricoh Company, Ltd.) and copies were made to evaluate the liquid developer No. 1.

As a result, the image density of the obtained toner image was 1.43, the image-fixing ratio was 89% when measured by the clockmeter method. In addition, the image fixing was achieved at a temperature of as low as 130° C. Further, there was no toner deposition on the surface of the photoconductor even after 7-days intermission of the copying machine.

Example 2

100 g of copper phthalocyanine blue was placed in a 1-l flask, and cooled to −10° C. with the addition thereto of 50 g of hydrochloric acid. To this mixture, 150 g of sodium nitrite ($NaHNO_2$) was added dropwise over a period of 4 hours, and the reaction was further carried out for 4 hours, so that a nitrite of copper phthalocyanine blue was synthesized.

Then, with the addition of 10 g of zinc powder, the nitrite thus synthesized was subjected to reflux reaction at −10° C. for 8 hours, so that an amino compound of copper phthalocyanine blue was obtained.

Thereafter, the amino compound of copper phthalocyanine blue was turned into a diazo compound thereof by use of sodium nitrite. The thus obtained compound was subjected to centrifugation, washed with water, and dried. Thus, 94 g of a diazo compound of copper phthalocyanine blue (A) was obtained.

The following components were mixed in a flask:

| | Parts by Weight |
|---|---|
| Methacrylic acid | 30 |
| Stearyl methacrylate | 100 |
| Diazo compound of copper phthalocyanine blue (A) | 10 |
| Isopar H | 500 |

The above prepared mixture was exposed to mercury vapor lamp with stirring. As a result, the diazo compound of phthalocyanine blue (A) was decomposed to generate a radical, thereby initiating the polymerization of methacrylic acid and atearyl methacrylate. Thus, a pigment (copper phthalocyanine blue)—polymer was synthesized.

Thus, a toner for use in the present invention was prepared.

According to the electron microscope photograph of the toner, there were observed fibrous toner particles and amorphous toner particles at the mixing ratio by number of about 60:40.

20 g of the above prepared toner was dispersed in 1,000 g of the commercially available aliphatic hydrocarbon (Trademark "Isopar H", made by Exxon Chemical Japan Ltd.), so that a liquid developer No. 2 of the present invention was obtained.

The liquid developer No. 2 was set in a commercially available copying machine (Trademark "Ricopy FT400i", made by Ricoh Company, Ltd.) and copies were made to evaluate the liquid developer No. 2.

As a result, the image fixing ratio was 86% when measured by the clockmeter method. In addition, the image fixing was achieved at a temperature of as low as 120° C. Further, there was no toner deposition on the surface of the photoconductor even after 7-days intermission of the copying machine.

In addition, the above-mentioned copying machine was modified in such a manner that an intermediate image-transfer drum made of silicone was set in the image-transfer unit. when the toner images formed on the photoconductor were once transferred to the intermediate image-transfer drum, and the thus transferred toner images were further transferred to a transfer sheet with the application of pressure thereto, the image-transfer ratio was 100% and the image-fixing ratio was increased to 92%. In this case, the image-transfer ratio was obtained in accordance with the following formula:

$$\text{Image-transfer ratio (\%)} = \frac{\text{Weight of toner transferred to transfer sheet}}{\text{Weight of toner deposited on intermediate image-transfer drum}} \times 100$$

Example 3

A mixture of the following components was dispersed in a keddy mill for 4 hours:

| | Parts by Weight |
|---|---|
| Lauryl methacrylate/glycidyl methacrylate/acrylamide copolymer (molar ratio of 40:20:40) | 30 |
| Pigment Yellow 12 | 10 |
| Isopar H | 70 |

Thus, a negatively-chargeable toner for use in the present invention, with a volume mean particle diameter of 0.3 μm was obtained, which contained fibrous toner particles and amorphous toner particles at the mixing ratio by number of about 50:50

50 g of the above prepared toner was dispersed in 1,000 g of the commercially available aliphatic hydrocarbon (Trademark "Isopar H", made by Exxon Chemical Japan Ltd.), so that a liquid developer No. 3 according to the present invention was obtained.

The liquid developer No. 3 was set in a commercially available copying machine including the development process as shown in FIG. 3, and copies were made to evaluate the liquid developer No. 3. In this case, the surface potential of the photoconductor drum 7 was set at 900 V, the voltage applied to the visible toner images formed on the photoconductor drum 7 by the voltage-application roller 18 was −1000 V, and an electric current of 10 μA was caused to flow through the visible toner images to the photoconductor drum 7. The voltage-application roller 18 was out of contact with the visible toner images formed on the photoconductor drum 7, and disposed downstream of the squeegee roller 17 in terms of the direction of the rotation of the photoconductor drum 7.

As a result, the image density of the obtained toner image was 1.38, the resolution was 7.5 lines/mm, the density of the background was as low as 0.02.

Example 4

A mixture of the following components was dispersed in an attritor at 120° C. for 3 hours:

| | Parts by Weight |
|---|---|
| Rosin-modified maleic resin | 40 |
| Pigment Red 122 | 10 |
| Isopentyl myristate | 50 |
| Lecithin | 0.1 |

The above prepared mixture was further dispersed for 4 hours with cooling to room temperature.

Thus, a toner with a volume mean particle diameter of 1.8 μm for use in the present invention was obtained, which contained spherical toner particles and amorphous toner particles at the ratio by number of about 32:68.

50 g of the above prepared toner was dispersed in 1,000 g of isopentyl myristate, so that a liquid developer No. 4 of the present invention was obtained.

The liquid developer No. 4 was set in the same copying machine as employed in Example 3, and copies were made under the same conditions as in Example 3 to evaluate the liquid developer No. 4.

As a result, the image density of the obtained toner image was 1.42, the resolution was 8.2 lines/mm, and the image-fixing ratio was 89%.

The initial toner concentration of the liquid developer No. 4 was 50 wt. %. The toner concentration was controlled to 95 wt. % by concentrating the liquid developer under reduced pressure using an evaporator. In addition, the copying machine (Trademark "FT-400i", made by Ricoh Company, Ltd.) was modified in such a fashion that the photoconductor was replaced by an organic photoconductor for use in the commercially available copying machine (Trademark "IMAGIO-MF530", made by Ricoh Company, Ltd.), which organic photoconductor was treated so as to be oil-repellent by providing an overcoat surface layer comprising a polycarbonate resin and finely-divided particles of polytetrafluoroothylene with a particle size of 0.5 μm (available from Daikin Industries, Ltd.) dispersed in the polycarbonate resin, and that the development roller was coated with a surface layer comprising a RTV silicone rubber (available from Shin-Etsu Chemical Co., Ltd.) in a thickness of 1.0 mm.

The previously obtained concentrated liquid developer was set in the above-mentioned modified copying machine, and copies were made. As a result, clear toner images were formed on the photoconductor drum and transferred to a sheet of copy paper. No toner deposition was observed on the photoconductor drum during the intermission of the copying machine.

Example 5

The following components were thoroughly kneaded in a flusher:

| | Parts by Weight |
|---|---|
| Stearyl methacrylate/ methacrylic acid copolymer (molar ratio of 50:50) | 200 |
| Dimethyl silicone oil (Trademark "KP96-300 cs", made by Shin-Etsu Chemical Co., Ltd.) | 500 |
| Pigment Red 146 (wet cake with solid component of 50 wt. %) | 200 |

Thus, the previously mentioned phthalocyanine compound No. (III)-8 was prepared by flushing treatment.

A mixture of 100 parts by weight of the abovementioned phthalocyanine pigment prepared by flushing treatment, 200 parts by weight of the commercially available silicone oil (Trademark "KF95", made by Shin-Etsu Chemical Co., Ltd.), and 0.5 parts by weight of polybutylenemaleimide was dispersed in an attritor for 6 hours, whereby a toner for use in the present invention was prepared, which contained amorphous toner particles and spherical toner particles at the mixing ratio by number of 50:50.

50 g of the above prepared toner was dispersed in 1,000 g of the commercially available silicone oil (Trademark "KF95", made by Shin-Etsu Chemical Co., Ltd.), so that a liquid developer No. 5 of the present invention was obtained.

The liquid developer No. 5 was set in the same copying machine as employed in Example 3, and copies were made to evaluate the liquid developer No. 5 under the same conditions as employed in Example 3.

As a result, the image density of the obtained toner image was 1.45, the resolution was 11 lines/mm, and the density of the background was as low as 0.02.

The initial toner concentration of the liquid developer No. 5 was 50 wt. %. The toner concentration was increased to 92 wt. % in the same manner as in Example 4. In addition, the copying machine (Trademark "FT-400i", made by Ricoh Company, Ltd.) was modified in such a fashion that the photoconductor drum was replaced by a photoconductor drum comprising amorphous-silicon which has been surface-treated to be oil-repellent.

The previously obtained concentrated liquid developer was set in the above-mentioned modified copying machine, and copies were made. As a result, clear toner images were formed on the photoconductor drum and transferred to a sheet of copy paper. There was no toner deposition on the surface of the photoconductor drum during the intermission of the copying machine.

Example 6

Using the same copying machine provided with the liquid developer No. 3 prepared in Example 3, copies were made in the same manner as in Example 3 except that the voltage applied to the visible toner images formed on the photoconductor drum 7 by the voltage-application roller 18 was changed to +1,000 V to cause an electric current of 10 $\mu$A to flow through the toner images to the photoconductor drum 7.

As a result, the image density of the obtained toner image was 1.30, the resolution was 7.1 lines/mm, and the density of the background was 0.08.

Example 7

Using the same copying machine provided with the liquid developer No. 3 prepared in Example 3, copies were made in the same manner as in Example 3 except that the voltage-application roller 18 for use in the development unit was changed to a voltage-application wire.

As a result, the image density of the obtained toner image was decreased to 1.26, the resolution was 6.3 lines/mm, and the density of the background was 0.02.

Comparative Example 1

Using the same copying machine provided with the liquid developer No. 3 prepared in Example 3, copies were made in the same manner as in Example 3 except that the voltage was applied to the visible toner images formed on the photoconductor drum 7 by the voltage-application roller 16 which was in contact with the toner images on the photoconductor drum 7.

As a result, the image density of the obtained toner image was 1.28, the resolution was 6.3 lines/mm, and the density of the background was 0.08.

Example 8

A mixture of the following components was kneaded at 120° C.;

| | Parts by Weight |
|---|---|
| Phthalocyanine blue | 100 |
| Styrene-butyl methacrylate-glycidyl methacrylate copolymer (molar ratio of 50:40:10) | 500 |

Thus, a coloring agent (A) kneaded in the resin was obtained.

The following components were dispersed in an attritor for 4 hours;

| | Parts by Weight |
|---|---|
| Coloring agent (A) | 100 |
| Phthalocyanine blue | 30 |
| Polylauryl methacrylate | 50 |
| Isopar H | 800 |

Thus, a toner for use in the present invention was prepared, which contained spherical toner particles and amorphous toner particles at the ratio by number of about 20:80.The melt viscosity of the toner particles for use in the toner was 890 Pa·sec at 120° C.

When the latent electrostatic images were developed to visible toner images using the above-mentioned toner, and the toner images were transferred and fixed on a transfer sheet by using a heat-application roller of 150° C., the off-set phenomenon did not occur.

50 g of the toner was dispersed in 1,000 g of the commercially available aliphatic hydrocarbon "Isopar H" (Trademark), made by Exxon Chemical Japan Ltd.

Thus, a liquid developer No. 6 according to the present invention was obtained.

The thus obtained liquid developer No. 6 was set in a copying machine including the development unit as shown in FIG. 3, and copies were made to evaluate the liquid developer No. 6.

As a result, the image-transfer ratio was 85%, and the stability of the liquid developer, namely, the life of the liquid developer was maintained until 30,000 copies were made. In this case, the life of the liquid developer is expressed by the maximum number of copy sheets subjected to copying operation before the image density of the obtained toner image is decreased to 1.0 or less.

Example 9

A mixture of the following components was kneaded, so that a coloring agent (B) kneaded in a resin was prepared:

| | Parts by Weight |
|---|---|
| Carbon black (Trademark "Mogul A", made by Cabot Corporation | 50 |
| Ethylene-butyl acrylate-vinylpyrrolidone-allylbutyl methacrylate copolymer (molar ratio of 50:40:5:5) | 200 |

The following components were dispersed in a beads mill for 3 hours:

| | Parts by Weight |
|---|---|
| Coloring agent (B) | 100 |
| Lauryl methacrylate-glycidyl methacrylate copolymer (molar ratio of 80:20) | 50 |
| Isopar H | 500 |

Thus, toner particles (a) of fibrous shape were prepared.

The following components were dispersed in a beads mill for 6 hours;

| | Parts by Weight |
|---|---|
| Carbon black (Trademark "Mogul A", made by Cabot Corporation | 50 |
| Lauryl methacrylate-glycidyl methacrylate copolymer (molar ratio of 80:20 | 50 |
| Isopar H | 500 |

Thus, toner particles (b) of amorphous shape were prepared.

30 parts by weight of the toner particles (a) and 70 parts by weight of the toner particles (b) were mixed and stirred in a magnetic stirrer for one hour, so that a toner C for use in the present invention was obtained, which contained fibrous toner particles and amorphous toner particles. The melt viscosity of the toner particles for use in the toner (c) was 1,060 Pa·sec at 120° C.

50 g of the above prepared toner (c) was dispersed in 1,000 g of the commercially available aliphatic hydrocarbon (Trademark "Isopar H", made by Exxon Chemical Japan Ltd.), so that a liquid developer No. 7 of the present invention was obtained.

The liquid developer No. 7 was set in a copying machine including the development unit as shown in FIG. 3, and copies were made to evaluate the liquid developer No. 7.

As a result, the image-transfer ratio was 86%, and the life of the liquid developer was maintained until 25,000 copies were made. In addition, the toner particles were not deposited on the surface of the photoconductor drum during 7-days intermission of the copying machine.

Comparative Example 2

50 g of the fibrous toner particles (a) prepared in Example 9 was dispersed in 1,000 g of the commercially available aliphatic hydrocarbon (Trademark "Isopar H", made by Exxon Chemical Japan Ltd.), so that a comparative liquid developer No. 1 was obtained.

When copies were made by using the comparative liquid developer No. 1 in the same manner as in Example 9, the image-transfer ratio was 75%. In addition, when 16,000 copies were made, the image density of the obtained toner image reached 1.0 or less. Further, there were observed the toner particles deposited on the surface of the photoconductor drum after 2-days intermission of the copying machine.

Comparative Example 3

50 g of the amorphous toner particles (b) prepared in Example 9 was dispersed in 1,000 g of the commercially available aliphatic hydrocarbon (Trademark "Isopar H", made by Exxon Chemical Japan Ltd.), so that a comparative liquid developer No. 2 was obtained.

When copies were made by using the comparative liquid developer No. 2 in the same manner as in Example 9, the image-transfer ratio was 45%. In addition, when 10,000 copies were made, the image density of the obtained toner image reached 1.0 or less.

Example 10

A mixture of the following components was dispersed in an attritor at 125° C. for 4 hours, cooled to room temperature, and pulverized, so that toner particles (d) of fibrous shape with a volume mean diameter of 4.3 μm were prepared:

| | Parts by Weight |
|---|---|
| Carmine 6B (available from DainichiSeika Color and Chemicals Mfg. Co., Ltd. | 100 |
| Ethylene-vinyl acetate copolymer (Trademark "ELVAX-II 5610", available from Du pont Kabushiki Kaisha) | 100 |
| Isopar L | 700 |
| Stearyl methacrylate-sodium methacrylate copolymer (molar ratio of 95:5) | 100 |

On the other hand, toner particles (e) of the spherical shape with a volume mean diameter of 0.38 μm were prepared by polymerization of an acrylic resin and a pigment of Carmine 6B in an amount of 50 wt %.

100 parts by weight of the fibrous toner particles (d) and 50 parts by weight of the spherical toner particles (e) were placed in a beaker and stirred for 40 minutes using a stirrer, so that a toner (f) for use in the present invention was obtained, which contained fibrous toner particles and spherical toner particles.

50 g of the above prepared toner (f) was dispersed in 1,000 g of the commercially available aliphatic hydrocarbon (Trademark "Isopar L", made by Exxon Chemical Japan Ltd.), so that a liquid developer No. 8 of the present invention was obtained.

The liquid developer No. 8 was set in a copying machine including the development unit as shown in FIG. 3, and copies were made to evaluate the liquid developer No. 8.

As a result, the image-transfer ratio was 90%, and the life of the liquid developer was maintained until 28,500 copies were made. In addition, the toner particles were not deposited on the surface of the photoconductor drum during the intermission of the copying machine.

Comparative Example 4

50 g of the fibrous toner particles (d) prepared in Example 10 was dispersed in 1,000 g of the commercially available aliphatic hydrocarbon (Trademark "Isopar L", made by Exxon Chemical Japan Ltd.), so that a comparative liquid developer No. 3 was obtained.

When copies were made by using the comparative liquid developer No. 3 in the same manner as in Example 10, the image-transfer ratio was 76.5%. In addition, when 19,000 copies were made, the image density of the obtained toner image reached 1.0 or less.

Comparative Example 5

50 g of the spherical toner particles (e) prepared in Example 10 was dispersed in 1,000 g of the commercially available aliphatic hydrocarbon (Trademark "Isopar L", made by Exxon Chemical Japan Ltd.), so that a comparative liquid developer No. 4 was obtained.

When copies were made by using the comparative liquid developer No. 4 in the same manner as in Example 10, the image-transfer ratio was 73%. In addition, when 15,000 copies were made, the image density of the obtained toner image reached 1.0 or less.

Example 11

A mixture of the following components was kneaded at 140° C., so that a coloring agent (c) kneaded in a resin was prepared:

| | Parts by Weight |
|---|---|
| Carbon black (Trademark "Mogul L", made by Cabot Corporation | 100 |
| Polyethylene (Trademark "Sanwax 171P", made by Sanyo Chemical Industries, Ltd.) | 100 |
| Ethylene-ethyl acrylate-acrylic acid-vinyltoluene copolymer (molar ratio of 60:30:5:5) | 150 |

The following components were dispersed in an attritor for 24 hours:

| | Parts by Weight |
|---|---|
| Coloring agent © | 100 |
| Lauryl methacrylate-methyl methacrylate-glycidyl methacrylate-methacrylic acid copolymer (molar ratio of 70:20:5:5) | 100 |
| Isopar L | 800 |

Thus, there was obtained a toner for use in the present invention, which contained fibrous toner particles and amorphous toner particles at the mixing ratio by number of about 40:60. The melt viscosity of the toner particles for use in the above-mentioned toner was 3,800 Pa·sec at 120° C.

60 g of the above prepared toner was dispersed in 1,000 g of the commercially available aliphatic hydrocarbon (Trademark "Isopar L", made by Exxon Chemical Japan Ltd.), so that a liquid developer No. 9 of the present invention was obtained.

The liquid developer No. 9 was set in a copying machine including the development unit as shown in FIG. 3, and copies were made to evaluate the liquid developer No. 9.

As a result, the image-transfer ratio was 92%, and the life of the liquid developer was maintained until 26,000 copies were made.

Example 12

100 parts by weight of the toner prepared in Example 11, comprising fibrous toner particles and amorphous toner particles, were mixed with 10 parts by weight of spherical toner particles prepared by coloring the commercially available acrylic resin particles of the spherical shape (Trademark "BR-89", made by Mitsubishi Rayon Co., Ltd.) with a volume mean diameter of 15 $\mu$m with crystal violet, and the above prepared mixture was dispersed. Thus, a toner for use in the present invention was obtained, which contained fibrous toner particles, amorphous toner particles and spherical toner particles.

60 g of the above prepared toner was dispersed in 1,000 g of the commercially available aliphatic hydrocarbon (Trademark "Isopar L", made by Exxon Chemical Japan Ltd.), so that a liquid developer No. 10 of the present invention was obtained.

The liquid developer No. 10 was set in a copying machine including the development unit as shown in FIG. 3, and copies were made to evaluate the liquid developer No. 10. In this case, the surface potential of the photoconductor drum 7 was set at 900 V, the voltage applied to the visible toner images formed on the photoconductor drum 7 by the voltage-application roller 18 was −1000 V, and an electric current of 10 $\mu$A was caused to flow through the visible toner images to the photoconductor drum 7. The voltage-application roller 19 was out of contact with the visible toner images formed on the photoconductor drum 7, and disposed downstream of the squeegee roller 17 in terms of the direction of the rotation of the photoconductor drum 7.

As a result, the image-transfer ratio was 95%, the image density of the obtained toner image was 1.40, and the density of the background was 0.02. The life of the liquid developer was maintained until 35,200 copies were made.

Example 13

Using the same copying machine provided with the liquid developer No. 10 prepared in Example 12, copies were made in the same manner as in Example 12 except that the voltage applied to the visible toner images formed on the photoconductor drum 7 by the voltage-application roller 18 was changed to +1,000 V to cause an electric current of 10 $\mu$A to flow through the toner images to the photoconductor drum 7.

As a result, the image density of the obtained toner image was 1.25, the resolution was 7.1 lines/mm, the density of the background was 0.08, and the image-transfer ratio was 80%. In addition, when 18,500 copies were made, the image density of the toner images reached 1.0 or less.

Example 14

Using the same copying machine provided with the liquid developer No. 10 prepared in Example 12, copies were made in the same manner as in Example 12 except that the voltage-application roller 18 for use in the development unit was changed to a voltage-application wire.

As a result, the image density of the obtained toner image was decreased to 1.28, the resolution was 6.3 lines/mm, and the density of the background was 0.12. In addition, when 30,000 copies were made, the image density of the toner images reached 1.0 or less.

Comparative Example 6

Using the same copying machine provided with the liquid developer No. 10 prepared in Example 12, copies were made in the same manner as in Example 12 except that the voltage was applied to the visible toner images formed on the photoconductor drum 7 by the voltage-application roller 18 which was in contact with the toner images on the photoconductor drum 7.

As a result, the image density of the obtained toner image was 1.18, the resolution was 6.3 lines/mm, the density of the background was 0.03, and the image-transfer ratio was 76%. In addition, when 15,000 copies were made, the image density of the toner images reached 1.0 or less, As is apparent from the above-mentioned results, the life of the liquid developer was shortened, and the image blurring occurred and the uniformity of a solid image was degraded as compared with the results obtained in Example 12.

As previously explained, the toner for use in the present invention comprises at least two kinds of toner particles with different shapes selected from the group consisting of spherical toner particles, fibrous toner particles and amorphous toner particles, so that the image density of the obtained toner image is increased, the image-transfer ratio is upgraded. When a liquid developer is prepared by dispersing the above-mentioned toner in a carrier liquid, the life of the liquid developer is increased, the image-fixing can be achieved at low temperature, and the toner particles can be prevented from being deposited on the surface of the photoconductor drum during the intermission of the machine.

Further, when the melt viscosity of the toner particles for use in the toner is in the range of 50 to 10,000 Pa·sec at 120° C., the off-set phenomenon can effectively be avoided when the heat-application roller is used for the image-fixing step.

Japanese Patent Application No. 7-123156 filed on Apr. 24, 1995 and Japanese Patent Application No. 7-155523 filed on May 31, 1995 are hereby incorporated by reference.

What is claimed is:

1. A developer for use in electrophotography for developing latent electrostatic images to visible toner images, comprising at least two kinds of toner particles with different shapes selected from the group consisting of spherical toner particles, fibrous toner particles and amorphous toner particles, each of which toner particles comprises a coloring agent and a binder resin.

2. The developer as claimed in claim 1, wherein said coloring agent comprises at least one coloring component selected from the group consisting of a phthalocyanine pigment, a disazo pigment, a carmine pigment, a quinacridone pigment and carbon black.

3. The developer as claimed in claim 1, wherein said coloring agent is prepared by flushing treatment.

4. The developer as claimed in claim 2, wherein said coloring agent further comprises a resin and is prepared by said coloring component being kneaded in said resin.

5. The developer as claimed in claim 1, wherein said toner particles have a melt viscosity of 50 to 10,000 Pa·sec at 120° C.

6. The developer as claimed in claim 1, wherein said spherical toner particles have a volume mean diameter of at least 0.5 μm, said fibrous toner particles have a volume mean diameter of at least 0.5 μm, and said amorphous toner particles have a volume mean diameter of 0.5 μA or less.

7. A liquid developer for use in electrophotography for developing latent electrostatic images to visible toner images, comprising a toner and a carrier liquid in which said toner is dispersed, said toner comprising at least two kinds of toner particles with different shapes selected from the group consisting of spherical toner particles, fibrous toner particles and amorphous toner particles, each of which toner particles comprises a coloring agent and a binder resin.

8. The liquid developer as claimed in claim 7, wherein said coloring agent comprises at least one coloring component selected from the group consisting of a phthalocyanine pigment, a disazo pigment, a carmine pigment, a quinacridone pigment and carbon black.

9. The liquid developer as claimed in claim 7, wherein said coloring agent is prepared by flushing treatment.

10. The liquid developer as claimed in claim 8, wherein said coloring agent further comprises a resin and is prepared by said coloring component being kneaded in said resin.

11. The liquid developer as claimed in claim 7, wherein said toner particles have a melt viscosity of 50 to 10,000 Pa·sec at 120° C.

12. The liquid developer as claimed in claim 7, wherein said spherical toner particles have a volume mean diameter of at least 0.5 μm, said fibrous toner particles have a volume mean diameter of at least 0.5 μm, and said amorphous toner particles have a volume mean diameter of 0.5 μm or less.

13. An electrophotographic image formation method comprising the steps of:

forming latent electrostatic images on the surface of a rotatable photoconductor drum;

developing said latent electrostatic images to visible toner images by a liquid developer which is deposited on said latent electrostatic images by development means;

regulating the amount of said liquid developer deposited on said latent electrostatic images to a predetermined amount by squeegee roller means which is disposed downstream of said development means in terms of the direction of the rotation of said photoconductor drum, with a predetermined gap between said squeegee roller means and said photoconductor drum, after the development of said latent electrostatic images;

applying a voltage to said visible toner images formed on said photoconductor drum, thereby causing an electric current to flow through said visible toner images to said rotatable photoconductor drum by a a voltage application roller means which is out of contact with said visible toner images and disposed downstream of said squeegee roller means in terms of the direction of the rotation of said photoconductor drum, with a predetermined gap between said voltage application roller means and said photoconductor drum; and transferring said visible toner images to a transfer sheet, with said liquid developer comprising a toner and a carrier liquid in which said toner is dispersed, said toner comprising at least two kinds of toner particles with different shapes selected from the group consisting of spherical toner particles, fibrous toner particles and amorphous toner particles, each of which toner particles comprises a coloring agent and a binder resin.

14. The electrophotographic image formation method as claimed in claim 13, wherein said coloring agent for use in said toner comprises at least one coloring component selected from the group consisting of a phthalocyanine pigment, a disazo pigment, a carmine pigment, a quinacridone pigment and carbon black.

15. The electrophotographic image formation method as claimed in claim 13, wherein said coloring agent for use in said toner is prepared by flushing treatment.

16. The electrophotographic image formation method as claimed in claim 14, wherein said coloring agent for use in said toner further comprises a resin and is prepared by said coloring component being kneaded in said resin.

17. The electrophotographic image formation method as claimed in claim 13, wherein said toner particles have a malt viscosity of 50 to 10,000 Pa·sec at 120° C.

18. The electrophotographic image formation method as claimed in claim 13, wherein said spherical toner particles have a volume mean diameter of at least 0.5 μm, said fibrous toner particles have a volume mean diameter of at least 0.5 μm, and said amorphous toner particles have a volume mean diameter of 0.5 μm or less.

19. The electrophotographic image formation method as claimed in claim 13, wherein said squeegee roller means is rotated in the same direction as that of said rotatable photoconductor drum.

20. The electrophotographic image formation method as claimed in claim 13, wherein said development means is in the form of a roller with a predetermined gap between said development means and said photoconductor drum, said voltage application means is in the form of a roller with a predetermined gap between said voltage application means and said photoconductor drum, and the gap between said squeegee roller means and said photoconductor drum in smaller than any of the gap between said development means and said photoconductor drum and the gap between said voltage application means and said photoconductor drum.

* * * * *